US010940493B2

(12) United States Patent
Levake et al.

(10) Patent No.: US 10,940,493 B2
(45) Date of Patent: Mar. 9, 2021

(54) ACTUATOR AND NOZZLE INSERT FOR DISPENSING SYSTEMS

(71) Applicant: S. C. JOHNSON & SON, INC., Racine, WI (US)

(72) Inventors: Kylie L. Levake, Union Grove, WI (US); Jeffrey J. Christianson, Oak Creek, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 195 days.

(21) Appl. No.: 16/046,377

(22) Filed: Jul. 26, 2018

(65) Prior Publication Data

US 2020/0030822 A1 Jan. 30, 2020

(51) Int. Cl.

| | |
|---|---|
| ***B05B 1/00*** | (2006.01) |
| ***B65D 83/28*** | (2006.01) |
| *B65D 83/14* | (2006.01) |
| *B05B 1/34* | (2006.01) |

(52) U.S. Cl.

CPC ..... *B05B 1/00* (2013.01); *B05B 1/3436* (2013.01); *B65D 83/28* (2013.01); *B65D 83/753* (2013.01)

(58) Field of Classification Search

CPC ..... B65D 83/14; B65D 83/16; B65D 83/20; B65D 83/205; B65D 83/207; B65D 83/28; B65D 83/753; B05B 1/00; B05B 1/3436

See application file for complete search history.

(56) References Cited

U.S. PATENT DOCUMENTS

| | | | | |
|---|---|---|---|---|
| 632,321 | A | 9/1899 | Olney | |
| 3,100,068 | A * | 8/1963 | Kersten | G01F 11/08 222/207 |
| 3,231,142 | A | 1/1966 | Mcghie | |
| 3,424,218 | A | 1/1969 | Vanderbur, Jr. | |
| 3,580,431 | A * | 5/1971 | Kuffer | B05B 1/3436 222/402.1 |
| 3,674,184 | A | 7/1972 | Ewald | |
| 3,722,725 | A | 3/1973 | Khetani | |
| 4,036,439 | A * | 7/1977 | Green | B05B 1/3436 239/466 |
| 4,071,196 | A * | 1/1978 | Burke | B05B 1/3436 239/492 |

(Continued)

FOREIGN PATENT DOCUMENTS

| | | |
|---|---|---|
| CA | 2834718 A1 | 5/2014 |
| CN | 106074230 A | 11/2016 |

(Continued)

OTHER PUBLICATIONS

International Search Report and Written Opinion issued in corresponding International Application PCT/US2019/034676, dated Sep. 20, 2019, 16 pages.

(Continued)

*Primary Examiner* — Darren W Gorman

(74) *Attorney, Agent, or Firm* — Quarles & Brady LLP

(57) ABSTRACT

A nozzle insert can be configured to be inserted along an insertion direction into a component of a product dispensing system. A stop portion on the nozzle insert can successively engage with a stop portion on the component when the nozzle insert is inserted into the component by different distances along the insertion direction.

20 Claims, 14 Drawing Sheets

(56) References Cited

U.S. PATENT DOCUMENTS

| | | | | |
|---|---|---|---|---|
| 4,074,861 | A * | 2/1978 | Magers | B05B 1/3436 239/492 |
| 4,566,600 | A | 1/1986 | Chang | |
| 4,609,418 | A | 9/1986 | Yoshino et al. | |
| 4,991,750 | A * | 2/1991 | Moral | B65D 83/303 222/402.24 |
| 5,540,389 | A * | 7/1996 | Knickerbocker | B05B 1/3431 239/463 |
| 6,302,302 | B1 | 10/2001 | Albisetti | |
| 7,036,691 | B2 | 5/2006 | Nicolas | |
| 7,121,434 | B1 | 10/2006 | Caruso | |
| 7,621,468 | B2 | 11/2009 | Smith et al. | |
| 9,227,213 | B2 * | 1/2016 | Bloc | B05B 1/00 |
| 9,862,535 | B2 | 1/2018 | Christianson et al. | |
| 2004/0112924 | A1 | 6/2004 | Albisetti | |
| 2004/0238573 | A1 * | 12/2004 | Parmentier | B05B 1/3436 222/321.1 |
| 2010/0308136 | A1 * | 12/2010 | Songbe | B05B 1/3436 239/492 |
| 2013/0037582 | A1 | 2/2013 | Andersen et al. | |
| 2017/0225178 | A1 * | 8/2017 | Kim | B05B 1/341 |
| 2017/0233171 | A1 | 8/2017 | Christianson et al. | |
| 2017/0341849 | A1 | 11/2017 | Wolak et al. | |
| 2018/0141744 | A1 * | 5/2018 | Cassidy | B65D 83/753 |

FOREIGN PATENT DOCUMENTS

| | | | |
|---|---|---|---|
| DE | 1055869 | B | 4/1959 |
| DE | 102010026720 | B3 | 12/2011 |
| EP | 0105202 | A1 | 4/1984 |
| EP | 2543444 | A1 | 1/2013 |
| EP | 2995385 | A1 | 3/2016 |
| FR | 1562239 | A | 4/1969 |
| FR | 2865463 | A1 | 7/2005 |
| FR | 2869301 | A1 | 10/2005 |
| FR | 3059573 | A1 | 6/2018 |
| GB | 980662 | A | 1/1965 |
| GB | 1161865 | A | 8/1969 |
| JP | S5179006 | A | 7/1976 |
| JP | 2001301853 | A | 10/2001 |
| JP | 2002193362 | A | 7/2002 |
| KR | 20110113249 | A | 10/2011 |
| KR | 20110128672 | A | 11/2011 |
| WO | 03095330 | A1 | 11/2003 |
| WO | 2004020313 | A1 | 3/2004 |
| WO | 2004020314 | A1 | 3/2004 |
| WO | 2004078635 | A2 | 9/2004 |
| WO | 2006058626 | A1 | 6/2006 |
| WO | 2006061099 | A1 | 6/2006 |
| WO | 2007022422 | A2 | 2/2007 |
| WO | 2008085896 | A2 | 7/2008 |
| WO | 2010052168 | A1 | 5/2010 |
| WO | 2011064584 | A1 | 6/2011 |
| WO | 2013022452 | A1 | 2/2013 |
| WO | 2013068190 | A1 | 5/2013 |
| WO | 2013068191 | A1 | 5/2013 |
| WO | 2013068219 | A1 | 5/2013 |
| WO | 2015127346 | A2 | 8/2015 |
| WO | 2015138241 | A1 | 9/2015 |
| WO | 2016043438 | A1 | 3/2016 |
| WO | 2016163987 | A1 | 10/2016 |

OTHER PUBLICATIONS

Examination report No. 1 for standard patent application issued in corresponding Australian Patent Application No. 2017217437, dated Jul. 25, 2018, 3 pages.

International Search Report and Written Opinion issued in corresponding International Application PCT/US2017/016843, dated May 10, 2017, 12 pages.

EP Communication pursuant to Article 94(3) EPC, EP17706065.4, dated Dec. 11, 2019, 8 pages.

Consumer Reports. Does Avon Skin So Soft Bath Oil Work as a Bug Spray? by Catherine Roberts. Jun. 27, 2017 <URL: https://www.consumerreports.org/insect-repellents/avon-skin-so-soft-review-bug-spray/>. (Year: 2017), 12 pages.

S.C. Johnson. New Beginnings in Ghana by Nina Henning. Oct. 8, 2014 [earliest online date], [site visited Apr. 24, 2018]. Available from Internet, <URL:http://www.scjohnson.com/en/commitment/better-lives/Article.aspx?date=14-10-088,title=New-Beginnings-in-Ghana>. (Year: 2014), 2 pages.

Japanese Office Action from corresponding Japanese Patent Application No. 2018-542257, dated Dec. 1, 2020 (6 pages).

* cited by examiner

ACTUATOR AND NOZZLE INSERT FOR DISPENSING SYSTEMS

CROSS-REFERENCE TO RELATED APPLICATIONS

Not applicable.

BACKGROUND

The present disclosure relates generally to dispensing systems and, more specifically, to a product dispensing system having an actuator with a nozzle insert.

Pressurized and non-pressurized containers are commonly used to store and dispense product that includes fluids and other materials, such as air fresheners, deodorants, insecticides, germicides, decongestants, perfumes, and the like. In some cases, materials can be stored in a pressurized and liquefied state within the container, and can be forced from the container by a propellant (e.g., a hydrocarbon or a non-hydrocarbon). In some cases, a release valve with an outwardly extending valve stem may be provided to facilitate the release of the volatile material from the container, whereby activation of the valve via the valve stem causes volatile material to flow from the container through the valve stem. The release valve may be activated by tilting, depressing, or otherwise displacing the valve stem.

In some cases, nozzle assemblies for containers (e.g., as included on a larger actuator assembly) can include nozzle inserts and corresponding nozzle-insert cavities. During manufacturing (or at other times), a particular nozzle insert can be inserted into a particular nozzle-insert cavity to form a combined nozzle assembly that can provide a desired flow characteristic (e.g., spray pattern, flow rate, metering effect, and so on). Due to different manufacturing tolerances and errors (e.g., error in pressures applied by assembly machines), as well as user interactions, the nozzle inserts and/or nozzle-insert cavities can sometimes be over-compressed during assembly or at other times. In some cases, this can result in degradation of the dispensing capabilities of the nozzle assembly as a whole.

SUMMARY

In one embodiment of the present disclosure, a nozzle insert is configured to be inserted along an insertion direction into a component of a product dispensing system, wherein the component includes a sequence of stops separated along the insertion direction. The nozzle insert can include an outlet end, an inlet end, and a stepped profile. The stepped profile can be configured to successively engage the sequence of stops as the nozzle insert is inserted into the component along the insertion direction.

In another embodiment of the present disclosure, an actuator assembly for a product dispensing system includes a nozzle insert and an actuator. The nozzle insert can include an insert stop portion with a first insert stop surface and a second insert stop surface that are separated along an insertion direction. The actuator can include a nozzle-insert cavity, wherein the nozzle-insert cavity includes a cavity stop portion having a first cavity stop surface and a second cavity stop surface that are separated along the insertion direction. The nozzle insert can be configured to be inserted into the nozzle-insert cavity by a first distance along the insertion direction, for operation of the actuator to dispense product through the nozzle insert. With the nozzle insert inserted into the nozzle-insert cavity by a second distance that is equal to or greater than the first distance, the first insert stop surface can engage the first cavity stop surface to impede further insertion along the insertion direction, without the second insert stop surface engaging the second cavity stop. With the nozzle insert inserted into the nozzle-insert cavity by a third distance that is larger than the second distance, the second insert stop surface can engage the second cavity stop surface to further impede further insertion along the insertion direction.

In a different embodiment of the present disclosure, a product dispensing system includes a container, an actuator, and a nozzle insert. The container can include a valve assembly. The actuator can include a nozzle-insert cavity having a cavity stop portion, and can be configured to interact with the valve assembly to dispense product from the container. The nozzle insert can include an insert stop portion and can be configured to be inserted into the nozzle-insert cavity in an insertion direction, to an operational position, to dispense product through the nozzle insert. At least one of the cavity stop portion and the insert stop portion can include a first stop surface, and a second stop surface that is separated from the first stop surface in the insertion direction. The insert stop portion can initially engage the cavity stop portion at the first stop surface, but not at the second stop surface, to impede further movement along the insertion direction, as the nozzle insert is moved in the insertion direction at least one of: to the operational position and past the operational position. As the nozzle insert is further moved in the insertion direction, after the insert stop portion initially engages the cavity portion at the first stop surface, the insert stop portion can engage the cavity stop portion at the first stop surface and at the second stop surface to further impede further movement along the insertion direction.

DETAILED DESCRIPTION

Figure 1:
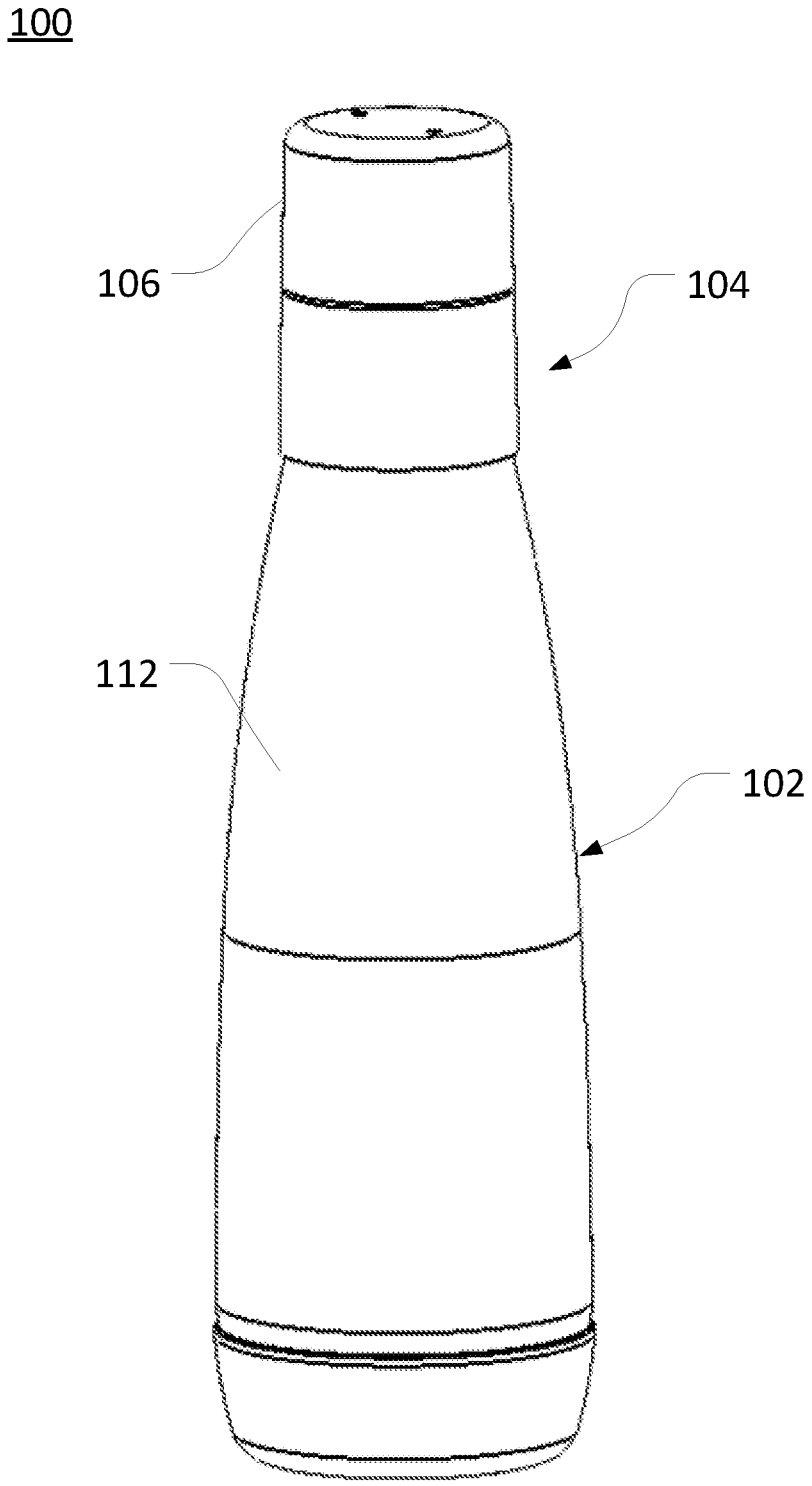
FIG. 1 is a top, front, left isometric view of a product dispensing system according to one embodiment.

Generally, embodiments of the present disclosure provide an actuator assembly, and components thereof, for a product dispensing system that may be actuated, for example, to initiate the dispensing of a product from a container through the actuator assembly. Some embodiments can include an actuator, and a nozzle insert configured to be inserted into the actuator during assembly, with the actuator including a stop portion arranged to interact with a distinct stop portion on the nozzle insert to prevent or otherwise mitigate effects of over-compression of the nozzle insert. For example, some embodiments can include an actuator having first and second stops configured to generate successive reaction forces against a nozzle insert, as the nozzle insert is inserted successively farther into the actuator, to mitigate the effects of over-compression. Similarly, some embodiments can include a nozzle insert with first and second stops configured to successively engage one or more structures within a nozzle-insert cavity (e.g., of an actuator), as the nozzle insert is inserted successively farther into the actuator, also to mitigate the effects of over-compression.

The use herein of the terms "downstream" and "upstream" generally indicate direction relative to the flow of a fluid. In this regard, the term "downstream" corresponds to the direction of a relevant fluid flow, while the term "upstream" refers to the direction opposite or against the direction of the relevant fluid flow.

The use herein of the term "axial" and variations thereof refers to a direction that extends generally along an axis of symmetry, a central axis, or an elongate direction of a particular component or system. For example, axially extending features of a component may be features that extend generally along a direction that is parallel to an axis of symmetry or an elongate direction of that component. Similarly, the use herein of the term "radial" and variations thereof refers to directions that are generally perpendicular to a corresponding axial direction. For example, a radially extending structure of a component may generally extend at least partly along a direction that is perpendicular to a longitudinal or central axis of that component.

The use herein of the term "separated" refers to features that are spaced apart from each other. For example, axially separated features of a component may be features that are spaced apart from each other along an axial direction. Unless otherwise specified or limited, use of the term "separated," is not intended to require any other particular alignment of features with respect to a referenced direction. For example, axially separated components may generally be spaced apart from each other relative to an axial direction, while being or not being disposed or otherwise aligned along a common axially extending reference line. Similarly, for example, radially separated components may generally be spaced apart from each other relative to a radial direction, while being separated from each other, or not separated from each other, relative to an axial direction.

In some embodiments, multiple stops provided in an actuator (or other component configured to receive a nozzle insert), and corresponding structures on a nozzle insert, can include axially separated and radially tiered features. For example, an actuator can include a nozzle-insert cavity with a set of steps toward an upstream (e.g., axially inner) end thereof, with a radially extending surface of one step of the set being axially spaced apart from and at least partly radially outside of a radially extending surface of another step of the set. Further, a corresponding nozzle insert can include a generally complementary set of steps on a corresponding (e.g., inlet) portion thereof. As the nozzle insert is inserted successively farther into the nozzle-insert cavity in an insertion direction (e.g., is inserted for operation, then further inserted due to over-compression), successive pairs of steps on the stop portions can successively engage each other to impede further movement of the nozzle insert in the insertion direction.

In some embodiments, a first stop on an actuator (or other component) and a first stop on a nozzle insert can engage upon insertion of the nozzle insert into the actuator to a first predetermined position (e.g., an operational position for optimal dispensing a product through the nozzle insert, or a position a predetermined distance past the operational position), in order to initially impede further insertion of the nozzle insert. Subsequently, upon insertion of the nozzle insert past the first predetermined position, a second stop on the actuator and a second stop on the nozzle insert can engage to further impede further movement of the nozzle insert. In this way, for example, the engagement of the first stops can provide a first protection against over-insertion of the nozzle insert, and the engagement of the second stops can provide a second, backup protection against over-insertion of the nozzle insert, including against over-insertion of the nozzle insert to the point that dispensing of a product through the nozzle insert is no longer possible.

Figure 2:
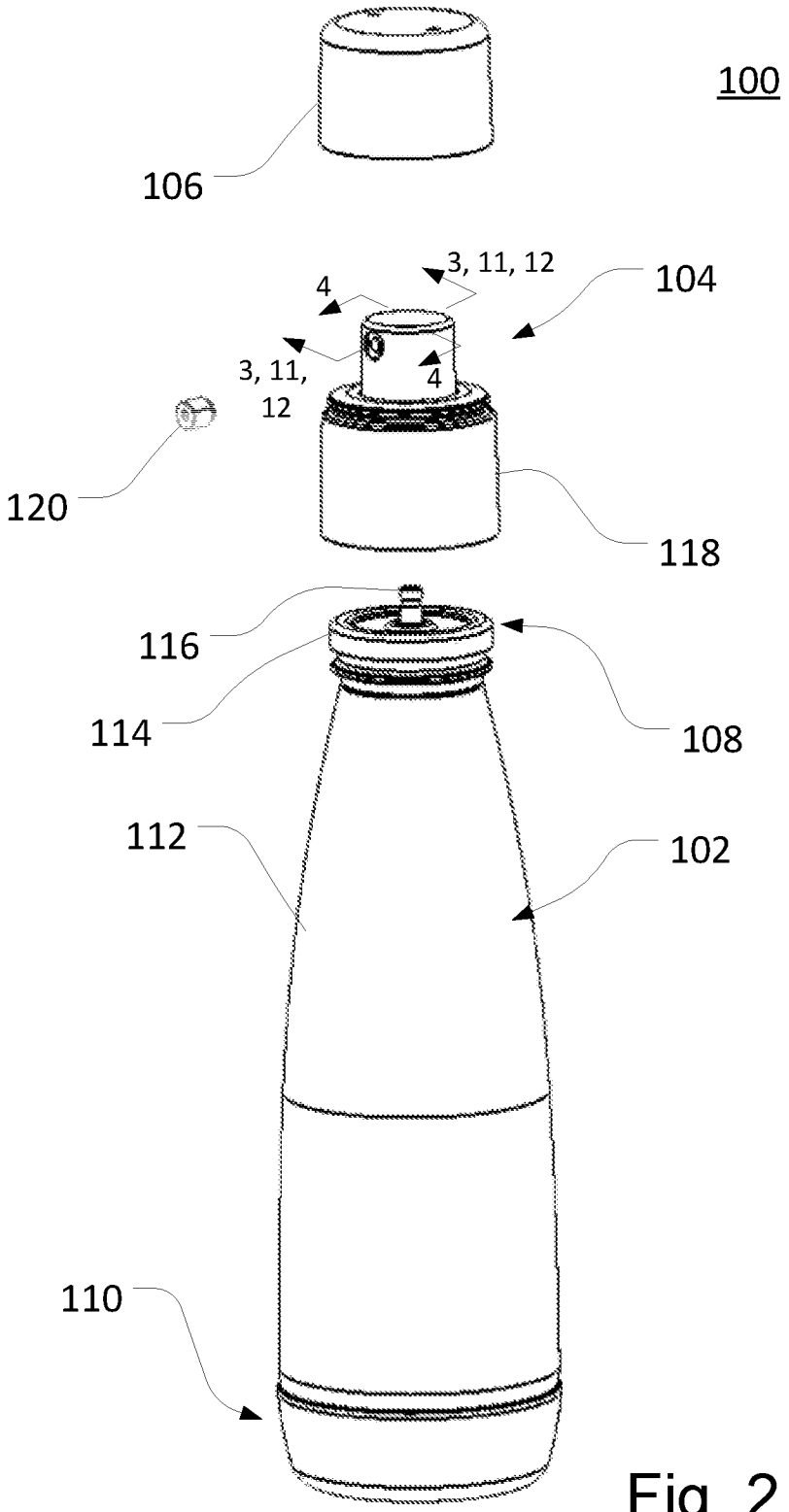
FIG. 2 is an exploded top, front, left isometric view of the product dispensing system of FIG. 1, including a nozzle insert, an actuator, and a valve stem.

FIGS. 1 and 2 illustrate a product dispensing system 100 for storing and/or dispensing a product according to one embodiment of the invention. The illustrated product dispensing system 100 includes a container 102, an actuator assembly 104 (only partially shown in FIG. 1), and a cover 106. In use, the actuator assembly 104 is configured to release the product from the container 102 upon the occurrence of a particular condition. For example, a user of the product dispensing system 100 may manually depress or otherwise activate the actuator assembly 104 to release the product from the container 102.

In general, the product to be dispensed may be any solid, liquid, or gas (or combination thereof) that is known to those skilled in the art as being capable of being dispensed from a container. In some embodiments, for example, the container 102 may contain any type of pressurized or non-pressurized product, such as compressed gas that may be liquefied, non-liquefied, or dissolved, including carbon dioxide, helium, hydrogen, neon, oxygen, xenon, nitrous oxide, or nitrogen. In some embodiments, the container 102 may contain any type of hydrocarbon gas, including acetylene, methane, propane, butane, isobutene, halogenated hydrocarbons, ethers, mixtures of butane and propane, otherwise known as liquid petroleum gas or LPG, and/or mixtures thereof. In some cases, the product discharged may be a fragrance or insecticide disposed within a carrier liquid, a deodorizing liquid, or the like. In some cases, the product may also include other actives, such as sanitizers, air fresheners, cleaners, odor eliminators, mold or mildew inhibitors, insect repellents, and/or the like, and/or may have aromatherapeutic properties. The product dispensing system 100 is therefore adapted to dispense any number of different products.

As illustrated in FIG. 2, the container 102 includes a first end 108 and a second end 110, and defines a substantially cylindrical, tapered body 112. In other embodiments, for example, the body 112 of the container 102 may define another shape, such as rectangular, round, polygonal, non-tapered, or other shapes. The second end 110 of the container includes a shoulder 114, which can be defined by a valve assembly (as illustrated) or another device or structure. In some embodiments, for example, the actuator assembly 104 is press-fit over a sealing structure arranged adjacent to or on the shoulder 114. For example, an assembly at the shoulder 114 may include a sealing structure in the form of an o-ring (not shown) over which the actuator assembly 104 may be seated. In some embodiments, the actuator assembly 104 can include internal structures (e.g., ribs) that help to engage the shoulder 114 (or other feature of or on the container 102) to secure the actuator assembly 104 in place. For example, the actuator assembly 104 may include internal structures configured for press-fit engagement with the shoulder 114 or other structures on the container 102.

In some embodiments, the container 102 supports a valve assembly or a pump (not shown) that is arranged at least partially within the container 102 and at least partially extends from the second end 110 of the container 102. In the illustrated embodiment, for example, the container 102 supports a valve assembly with a valve stem 116 that extends axially beyond the second end 110. The valve stem 116 is configured to interact with the actuator assembly 104 to enable the dispensing of the product from the container 102, as also described below.

Turning also to FIGS. 3-6, the actuator assembly 104 includes an actuator 118 that is configured to receive at least part of a nozzle insert 120 (see FIG. 2) into a portion thereof. In some embodiments, the actuator 118 may be fabricated from a unitary piece of material. In some embodiments, the actuator 118 may be fabricated from a plastic material. In some embodiments, the actuator 118 may be fabricated from a co-polymer, e.g., a polypropylene co-polymer. In some embodiments, the actuator 118 may be fabricated from polypropylene, propylene, HDPE, nylon, or other co- or homo-polymers.

Figure 3:
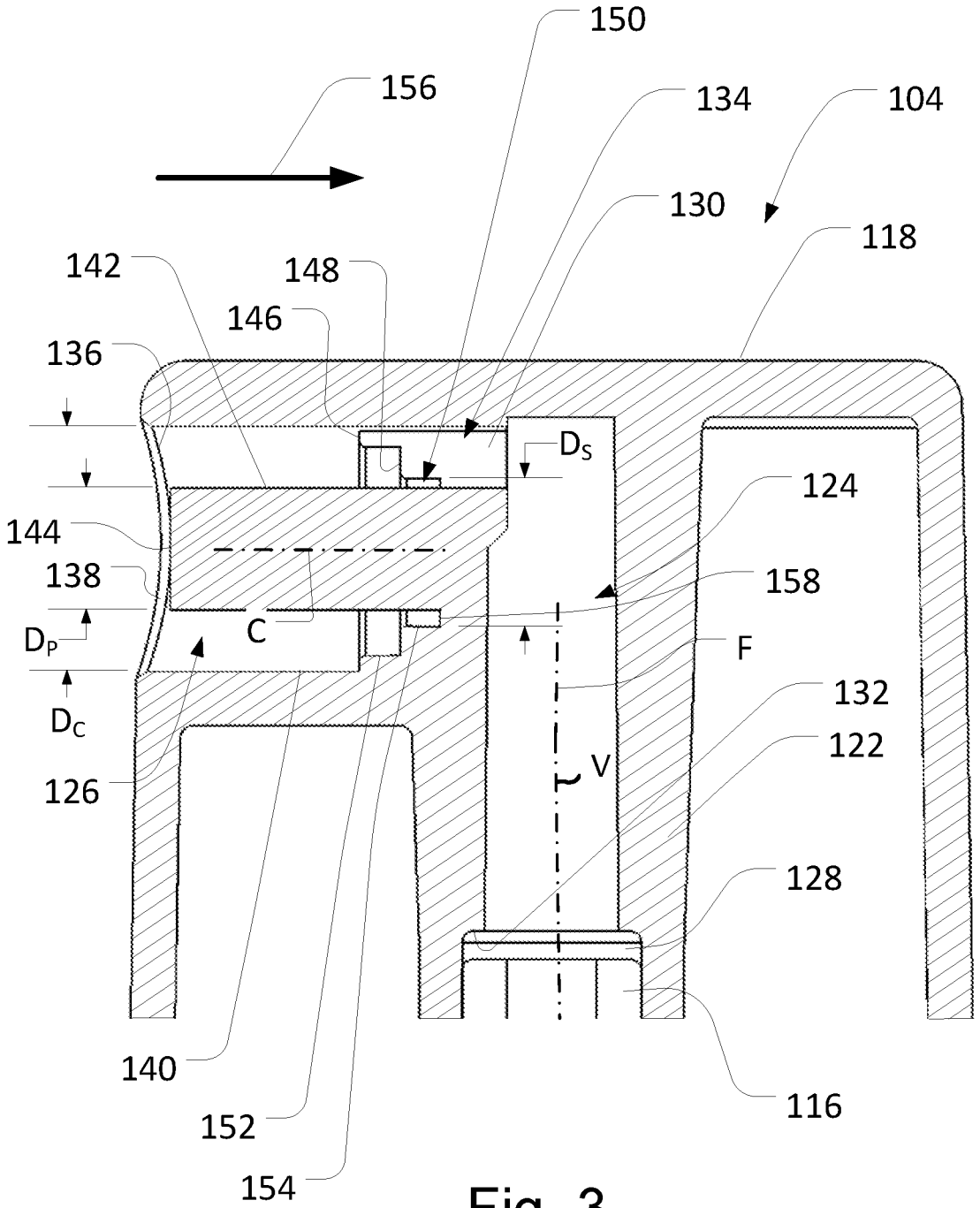
FIG. 3 is cross-sectional partial view of the actuator and the valve stem of the product dispensing system of FIG. 1 taken along line 3-3 of FIG. 2, with the nozzle insert hidden for purposes of clarity.
Figure 4:
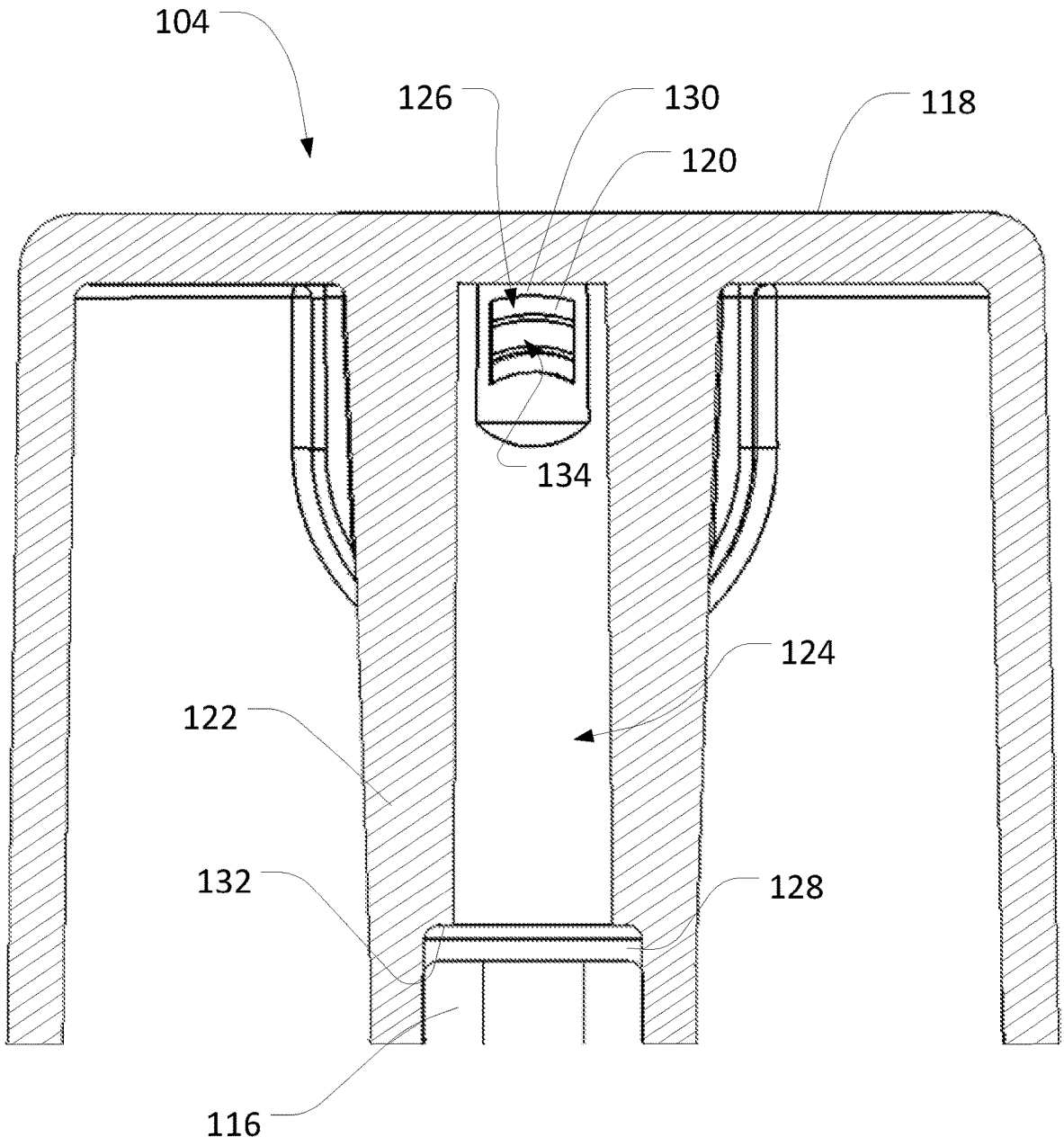
FIG. 4 is a cross-sectional partial view of the actuator and the valve stem of the product dispensing system of FIG. 1 taken along line 4-4 of FIG. 2, with the nozzle insert shown assembled with the actuator.
Figure 11:
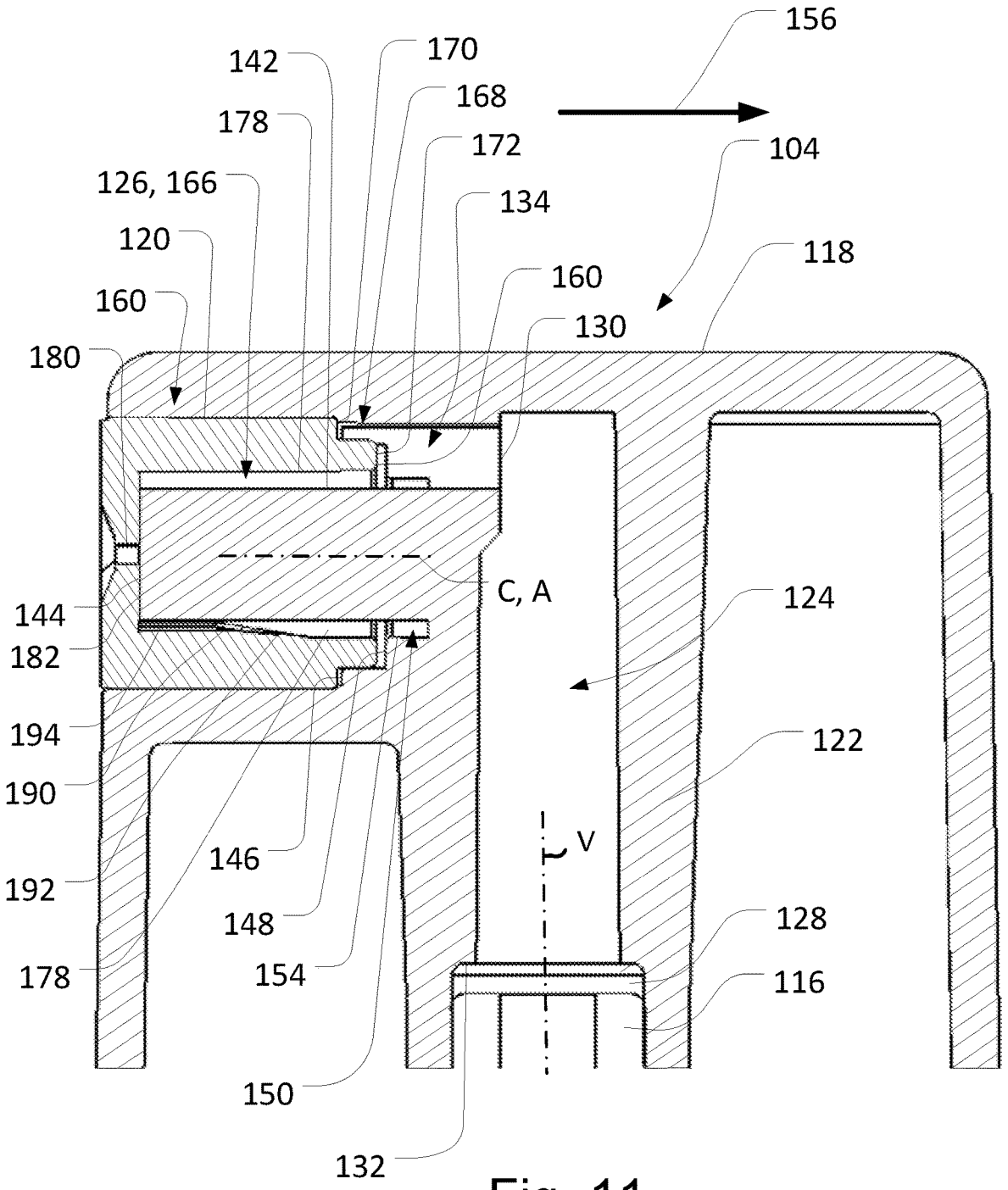
FIG. 11 is a partial cross-sectional view of the actuator, the nozzle insert, and the valve stem of FIG. 2 taken along line 11-11 of FIG. 2, with the nozzle insert at an operational position within the actuator.

As illustrated in FIGS. 3 and 4 in particular, the actuator 118 exhibits a generally annular shape and includes an inlet tube 122 with internal inlet passageway 124, and a nozzle-insert cavity 126 configured to receive the nozzle insert 120 (see also FIG. 11). The inlet passageway 124 defines a generally round bore that extends generally axially along a valve stem axis V. In other embodiments, for example, the inlet passageway 124 may define another cross-sectional shape, such as a rectangular, oval, or polygonal shape. The inlet passageway 124 includes an inlet at a port in a stem socket 128 and an outlet at a nozzle-cavity inlet 130. The stem socket 128 is arranged at a first end of the inlet passageway 124 and is configured to slidably receive at least a portion of the valve stem 116 therein. The nozzle-cavity inlet 130 is arranged at a second end of the inlet passageway 124, downstream of the stem socket 128, and is configured to provide fluid communication between the inlet passageway 124 and the nozzle-insert cavity 126.

In the illustrated embodiment, to engage and actuate the valve stem 116, the stem socket 128 defines a generally larger internal diameter than the inlet passageway 124 and includes a stem seat 132. In operation, for example, the actuator assembly 104 may be manually or automatically displaced to force engagement between the valve stem 116 and a portion of the stem socket 128 (e.g., the stem seat 132). With appropriate (e.g., further) actuation of the actuator assembly 104, the engagement between the valve stem 116 and the portion of the stem socket 128 or the stem seat 132 displaces the valve stem 116 such that the valve assembly opens and allows the product to flow from the container 102 through the valve stem 116 and into the inlet passageway 124.

In the illustrated embodiment, the nozzle-insert cavity 126 defines a generally cylindrical annular cavity that extends generally along a chamber axis C, from a stop portion 134 to an open end 136. Also in the illustrated embodiment, the chamber axis C is generally centrally located within the nozzle-insert cavity 126 and is arranged generally perpendicularly to the valve stem axis V and to a flow passage axis F, which corresponds with the valve stem axis V in the embodiment illustrated. In other embodiments, the chamber axis C may be arranged generally perpendicularly to another reference axis or feature, or may extend obliquely relative to the valve stem axis V, such as may be useful to orient a spray of product obliquely to the valve stem axis V. Further, the open end 136 includes a chamfered surface 138 that is configured to guide the nozzle insert 120 into the nozzle-insert cavity 126 during assembly.

In other embodiments, other configurations are possible. For example, in some embodiments, non-cylindrical or non-symmetrical profiles are possible, as are different (e.g., non-chamfered) configurations at the open end 136 and different orientations of the nozzle-insert cavity relative to the inlet passageway 124. A non-symmetrical profile may be useful, for example in order to allow for use of a wide-angle insert to provide a wide angle spray for foaming cleaners or other products.

For the description herein of features relating to or included within the nozzle-insert cavity 126, the use of the terms "axial," "radial," and "circumferential" (and variations thereof) are based on a reference axis corresponding to the chamber axis C. In this regard, for example, the nozzle-insert cavity 126 includes a radially outer surface 140 that extends as a generally circumferential barrel around the nozzle-insert cavity 126 and defines an outer diameter Dc thereof. Similarly, a post 142 within the nozzle-insert cavity 126 extends generally axially from a base near the stop portion 134 to a distal end 144 of the post 142 near the open end 136 of the nozzle-insert cavity 126.

In general, the shape and profile defined by the post 142 and by the nozzle-insert cavity 126 are configured to conform generally to one or more portions of the nozzle insert 120, to facilitate receipt and retention of the nozzle insert 120 within the nozzle-insert cavity 126. In the illustrated embodiment, for example, the post 142 and the nozzle-insert cavity 126 define generally cylindrical shapes configured to engage corresponding cylindrical (or other) features on the nozzle insert 120. In other embodiments, for example, the post 142 and/or the nozzle-insert cavity 126 may define different shapes to facilitate receipt and retention of particular nozzle inserts of other shapes and sizes.

As also discussed above, to help mitigate the effects of over-compression of nozzle inserts, one or more components of the product dispensing system 100 (e.g., the actuator 118) may include a stop portion (e.g., the stop portion 134) with a sequence of stops separated along an insertion direction for a relevant nozzle insert (e.g., the nozzle insert 120). In some embodiments, as illustrated for the stop portion 134, a stop portion can define a generally stepped profile. In general, the stop portion 134 can thereby provide multiple stops (e.g., with multiple radially-extending stop surfaces) to mitigate, or inhibit, axial over-insertion of the nozzle insert 120 into the nozzle-insert cavity 126.

As illustrated in FIG. 3 in particular, the stop portion 134 is configured as a tiered stop portion, with a first stop configured as a first cavity stop surface 146 and a second stop configured as a second cavity stop surface 148, as well as a partially open inlet distribution chamber 150. The first stop surface 146 defines a generally radially-extending surface (e.g., a surface arranged substantially along a plane that is generally perpendicular to the chamber axis C) that extends radially inward from the outer surface 140 to a junction between the first stop surface 146 and a first connecting surface 152. The first connecting surface 152 extends generally axially between the first stop surface 146 and the second stop surface 148. The second stop surface 148 defines a generally radially-extending surface that extends radially inward from a junction between the first connecting surface 152 and the second stop surface 148 to a junction between the second stop surface 148 and a second connecting surface 154. Therefore, the first stop surface 146 and the second stop surface 148 provide generally radially-extending surfaces that are arranged at different axial locations along the chamber axis C (i.e., are axially separated) and are configured to substantially limit, or inhibit, axial displacement of the nozzle insert 120 in an insertion direction 156 that extends from the open end 136 toward the stop portion 134.

In some embodiments, two or more stops of a stop portion can be axially separated and radially tiered, with each successive stop along an axial direction exhibiting a different radial extent into the nozzle-insert cavity than the last. As also described above, for example, the first stop surface 146 is arranged radially outwardly relative to the second stop surface 148. Further, the first stop surface 146 is arranged at an axial location that is between the open end 136 and a junction between the inlet passageway 124 and the nozzle-cavity inlet 130, and the second stop surface 148 is arranged at an axial location between the first stop surface 146 and the junction between the inlet passageway 124 and the nozzle-cavity inlet 130. In other words, the first stop surface 146 is located axially closer to the open end 136 of the nozzle-insert cavity 126 than is the second stop surface 148, and is radially closer to the radially outer surface 140 of the nozzle-insert cavity 126 than is the second stop surface 148.

An arrangement with the first stop surface 146 located radially closer to the radially outer surface 140 can be useful, for example, in order to assist during assembly of the actuator assembly 104. For example, with the illustrated configuration of the first and second stop surface 146, 148, corresponding features on an insert, such as a stepped stop portion 168 on the nozzle insert 120 (see, e.g., FIGS. 7 and 8), can provide a natural lead-in to assist in alignment during insertion of the insert with the nozzle insert cavity 126. In other embodiments, however, other configurations are possible, including configurations in which a feature similar to the second stop surface 148 is located radially closer to a radially outer surface of a nozzle-insert cavity than is a feature similar to the first stop surface 146.

In the embodiment illustrated, the first cavity stop surface 146 also extends over a generally smaller radial distance (i.e., exhibits a smaller radial extent) than does the second cavity stop surface 148. This may be useful, for example, to improve manufacturability for molding arrangements in which molding features for the first stop surface 146 are defined on a mold cavity and molding features for the second stop surface 148 are defined on an ejector sleeve. For example, in such a molding arrangement, providing a relatively large radial dimension for the second stop surface 148, or another feature formed by an ejector sleeve, can usefully provide a relatively large space for ejection of a formed part by the ejector sleeve. Further, such an arrangement can allow for greater control over the precise location of the stop features that will be first engaged during over-compression of an insert, such as stop features that include the first stop surface 146, based on the relatively more precise control enabled by using a steel mold cavity rather than an ejector sleeve to define those first-engaged features. As another example, providing a relatively large radial dimension for the second stop surface 148 can help to provide appropriately thick walls for reliable formation of the actuator 118 generally.

In the illustrated embodiment, the stop portion 134 includes chamfers at the junction between the first stop surface 146 and the first connecting surface 152 and the junction between the second stop surface 148 and the second connecting surface 154. In other embodiments, for example, the stop portion 134 may define fully squared transitions (i.e., with no chamfer or otherwise tapered surface) at the junction between the first stop surface 146 and the first connecting surface 152, at the junction between the second stop surface 148 and the second connecting surface 154, or elsewhere.

As also noted above, in some embodiments, a stop portion can also define a distribution chamber. Still referring to FIG. 3 in particular, in the illustrated embodiment, the inlet distribution chamber 150 is arranged axially closer to the junction between the inlet passageway 124 and the nozzle-cavity inlet 130 than is the second stop surface 148. That is, the distribution chamber 150 is arranged generally upstream of the second stop surface 148, between the second stop surface 148 and the junction between the inlet passageway 124 and the nozzle-cavity inlet 130. The distribution chamber 150 is also partly enclosed on three sides by the post 142, which forms a radially inner wall of the distribution chamber 150, the second connecting surface 154, which forms a radially outer wall of the distribution chamber 150, and a distribution surface 158 that extends generally radially between the second connecting surface 154 and the post 142. Correspondingly, the distribution chamber 150 includes an open end downstream of the distribution surface 158 to facilitate fluid flow into the interior of the nozzle insert 120, when the nozzle insert 120 is inserted into the nozzle-insert cavity 126 (see, e.g., FIG. 11). As also discussed below, the distribution chamber 150 is open along a region that is aligned with the nozzle-cavity inlet 130, which can allow product to flow from the inlet passageway 124, through the nozzle-cavity inlet 130, and into the distribution chamber 150.

In the illustrated embodiment, the distribution chamber 150 defines an outer diameter $D_S$ that is larger than a diameter $D_P$ of the post 142, which can enable fluid to flow around the post 142 within the distribution chamber 150. In some embodiments, the outer diameter $D_S$ may be designed such that fluid flow may be appropriately distributed around the post 142 and within the nozzle insert 120, in order to provide a desired swirl (or other) flow pattern.

Figure 5:
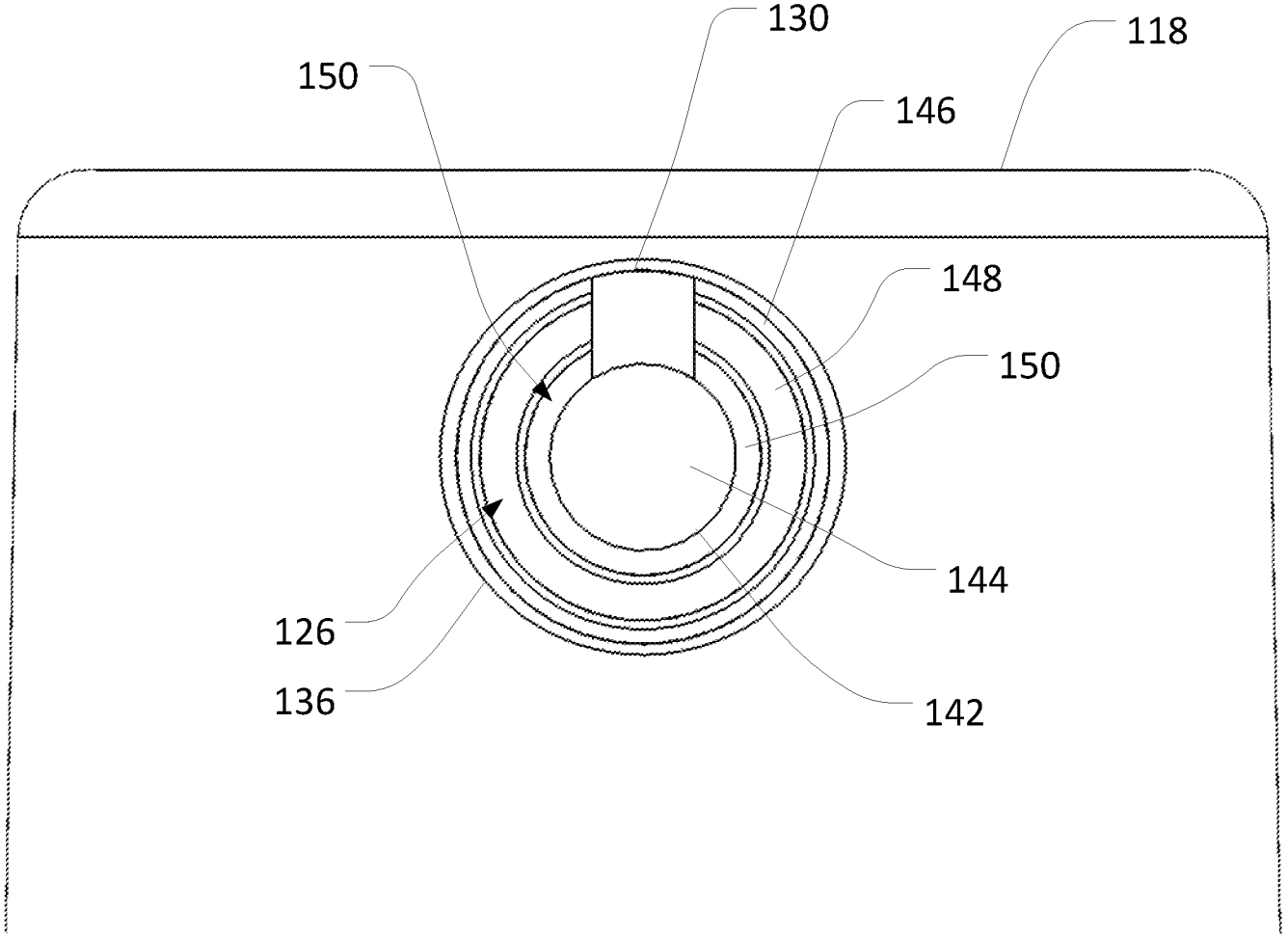
FIG. 5 is a partial left side view of the actuator of the product dispensing system of FIG. 1, with the nozzle insert hidden for purposes of clarity.
Figure 6:
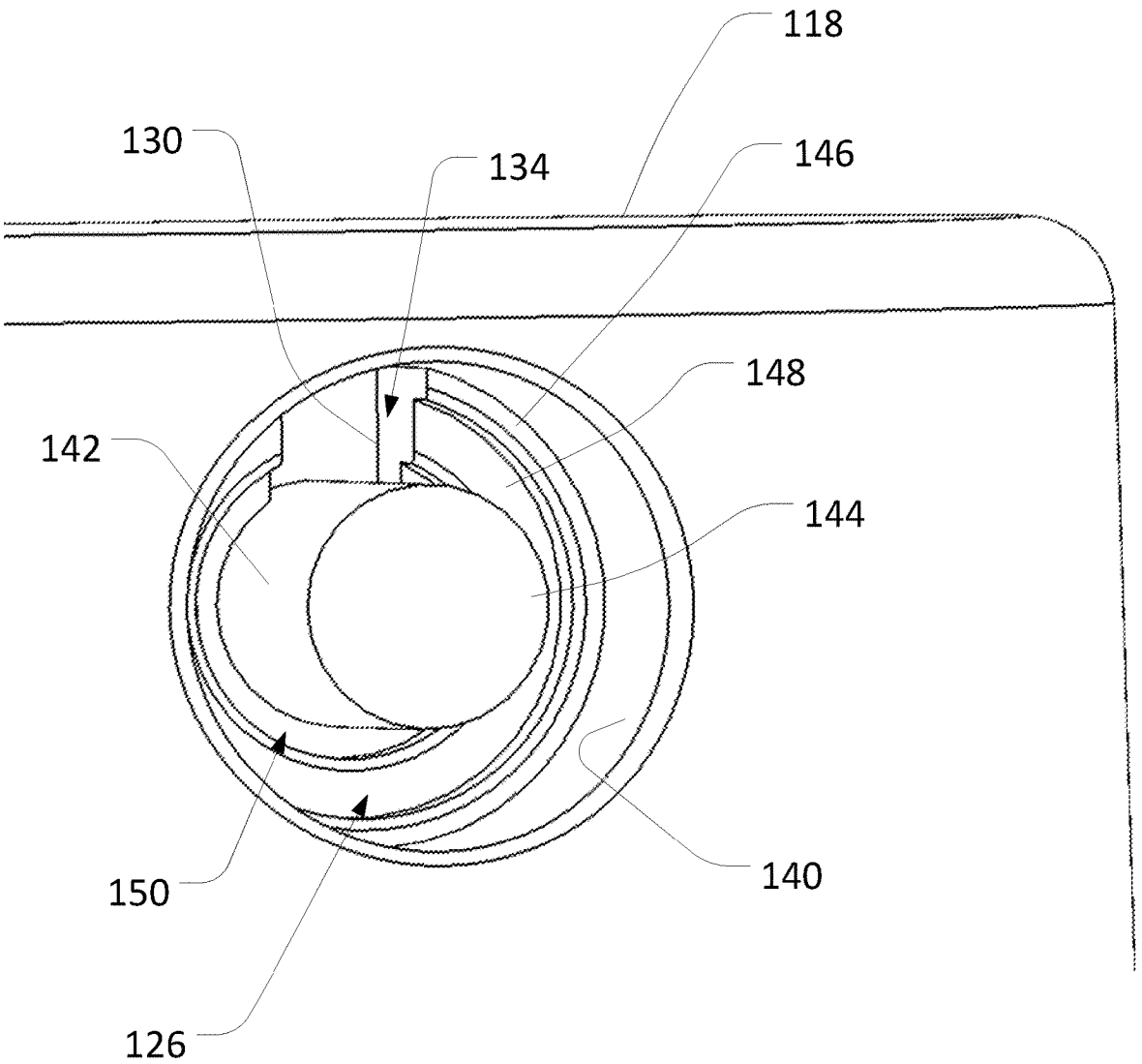
FIG. 6 is a partial top, back, left, isometric view of the actuator of FIG. 5.

With specific reference to FIGS. 4-6, the nozzle-cavity inlet 130 extends through at least a portion of the stop portion 134 to provide fluid communication between the inlet passageway 124 and the nozzle-insert cavity 126. In particular, as also illustrated in FIG. 3, the nozzle-cavity inlet 130 extends axially through the first stop surface 146, the second stop surface 148, the first connecting surface 152, the second connecting surface 154, and the distribution surface 158. As such, the nozzle-cavity inlet 130 provides a circumferential interruption in the structures of the stop portion 134, such that none of the first stop surface 146, the second stop surface 148, and the distribution chamber 150 forms a full (i.e., 360 degree) annular ring.

In other embodiments, other configurations are possible. In some embodiments, one or more stops of a stop portion (e.g., the first stop surface 146 and/or the second stop surface 148) may be formed as a set of ribs (not shown), or other discrete protrusions, as opposed to relatively continuous radially-extending surfaces that extend circumferentially around a nozzle-insert cavity (e.g., except for an interruption by a nozzle-cavity inlet or other feature). For example, in some embodiments, the first stop surface 146 may remain substantially as illustrated in FIGS. 3, 5, and 6, while the second stop surface 148 may be formed from a set of ribs (not shown), with each rib arranged between axially-extending, radially recessed portions of the nozzle-insert cavity 126. In some cases, the use of ribs (or other discrete protrusions) as opposed to relatively continuous surfaces may introduce a benefit of removing material from a portion of the actuator 118. This can, for example, result in walls of reduced and/or more uniform thickness (e.g., between the inlet passageway 124 and the nozzle-insert cavity 126), which can provide corresponding benefits for manufacturing.

FIGS. 7-10 illustrate the nozzle insert 120 according to one embodiment of the present invention. The nozzle insert 120 is configured to be inserted at least partially into the nozzle-insert cavity 126 and to thereby promote the dispensing of the product within the container 102 to the surroundings with appropriate fluid flow characteristics. In some embodiments, the nozzle insert 120 may be fabricated from a plastic material. In some embodiments, for example, the nozzle insert 120 may be fabricated from an acetal, i.e., polyoxymethylene, material. In some embodiments, for example, the nozzle insert 120 may be fabricated from polypropylene, propylene, HDPE, nylon, or other co- or homo-polymers.

The nozzle insert 120 includes a nozzle body 160 that defines a generally annular cylinder extending generally axially between a generally closed insert outlet end 162 and a generally open insert inlet end 164. In other embodiments, for example, the nozzle body 160 may define other shapes, such as rectangular, oval, polygonal, tapered or other shapes, as appropriate. As also discussed below, the inlet end 164 of the nozzle insert 120 can provide access to an interior cavity 166, to enable the post 142 to be slidably received within the interior cavity 166.

Figure 8:
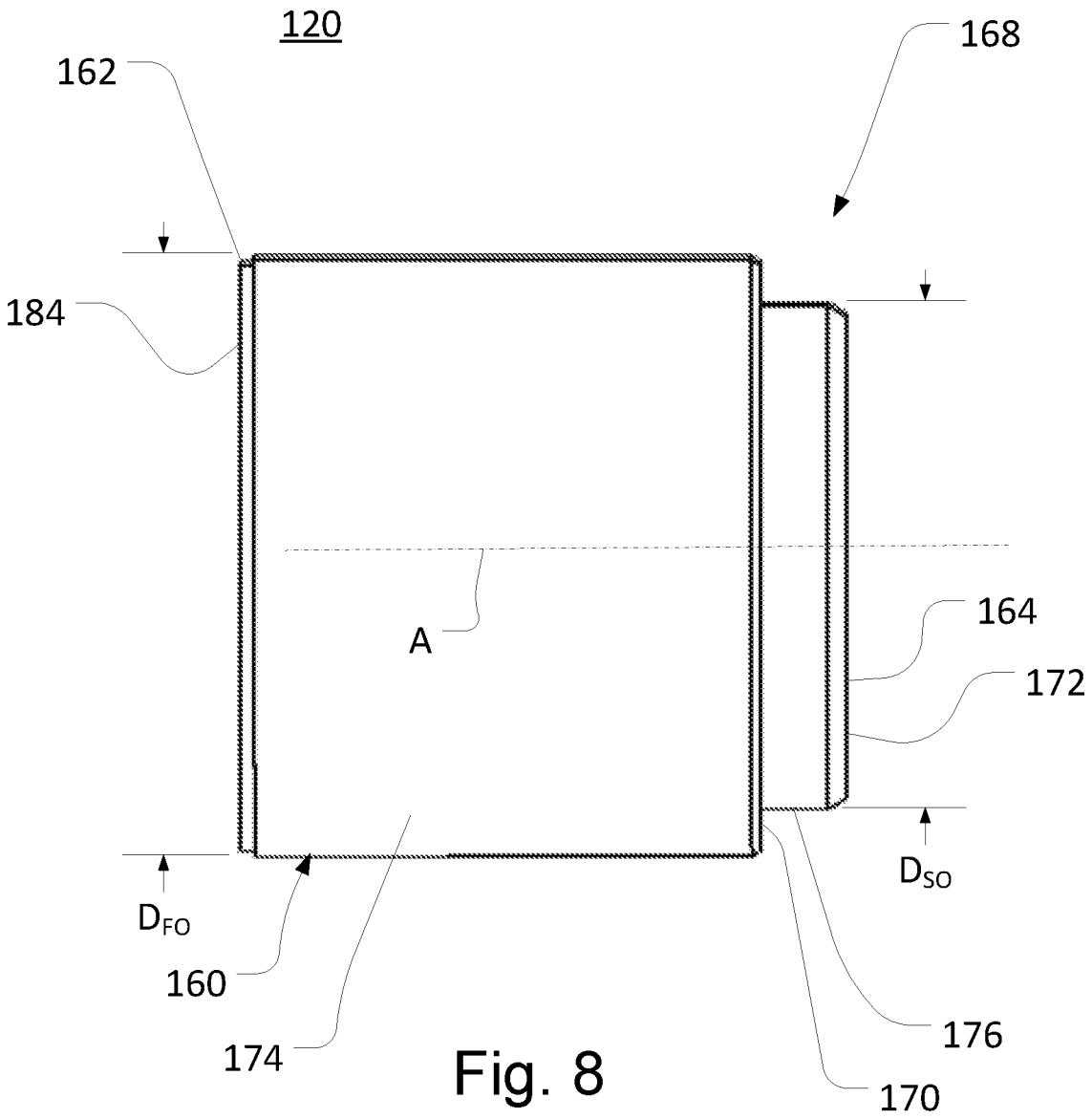
FIG. 8 is a front view of the nozzle insert of FIG. 2.
Figure 10:
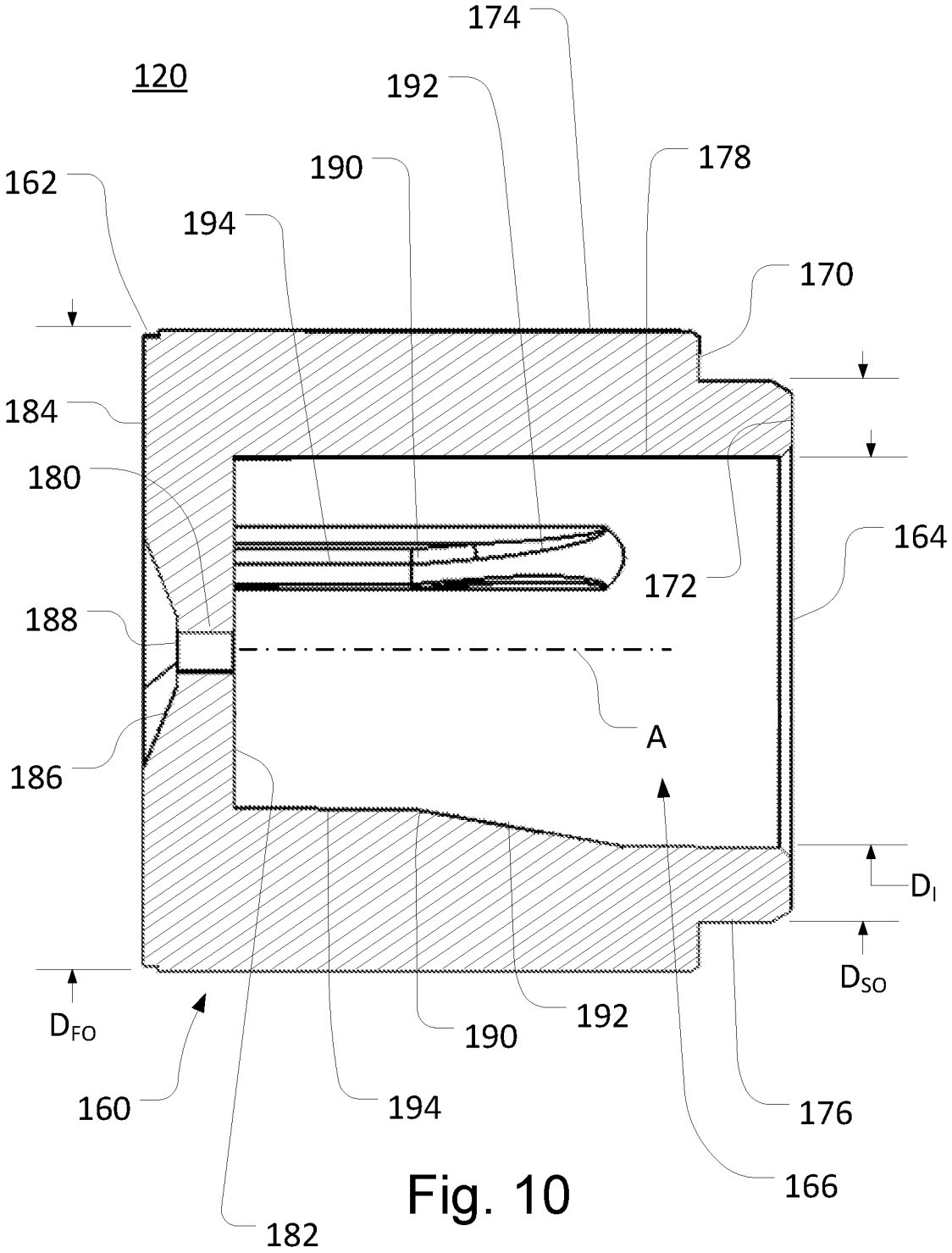
FIG. 10 is a cross-sectional view of the nozzle insert of FIG. 2 taken along line 10-10 of FIG. 9.

In order to provide a configuration of the stop portion 168 that generally corresponds to the stop portion 134 of the nozzle-insert cavity 126 (see, e.g., FIG. 3), the nozzle body 160 can define a generally stepped profile adjacent to the insert inlet end 164. In the illustrated embodiment, for example, as shown in FIGS. 8 and 10 in particular, the nozzle body 160 defines a change in outer diameter from a first outer diameter $D_{FO}$ to a second outer diameter $D_{SO}$ at an axial location (relative to a central axis A) that is between the insert outlet end 162 and the insert inlet end 164. In the illustrated embodiment, the first outer diameter $D_{FO}$ is greater than the second outer diameter $D_{SO}$. In other embodiments, other configurations are possible.

In general, a profile defined by the stop portion 168 of the nozzle body 160 (e.g., adjacent to the insert inlet end 164) is designed to interact with the stop portion 134 of the actuator 118 (see, e.g., FIG. 3) to provide engagement (e.g., successive engagement) between the two stop portions 168 and 134 to impede over-insertion of the nozzle body 160 into the nozzle-insert cavity 126. In the illustrated embodiment, for example, the stop portion of the nozzle insert 120 includes stops configured as a first insert stop surface 170 and a second insert stop surface 172 (see FIGS. 8-10), which define respective generally radially-extending surfaces (e.g., surfaces arranged substantially in a plane that is generally perpendicular to the central axis A). The first insert stop surface 170 extends generally radially inward between a first outer surface 174, which defines the first outer diameter $D_{FO}$, and a second outer surface 176, which defines the second outer diameter $D_{SO}$. The second insert stop surface 172 is arranged on the inlet end 164 of the nozzle body 160 and extends generally radially between the second insert outer surface 176 and an interior surface 178 of the nozzle body 160 (i.e., a radially outer surface of the interior cavity 166). In the embodiment illustrated, the first insert stop surface 170 extends over a generally smaller radial distance than does the second insert stop surface 172, and the second insert stop surface 172 is arranged radially inward relative to the first insert stop surface 170. This corresponds, for example, to the relative dimensions and locations of the stop surfaces 146, 148 of the stop portion 134 (see, e.g., FIG. 3).

Figure 9:
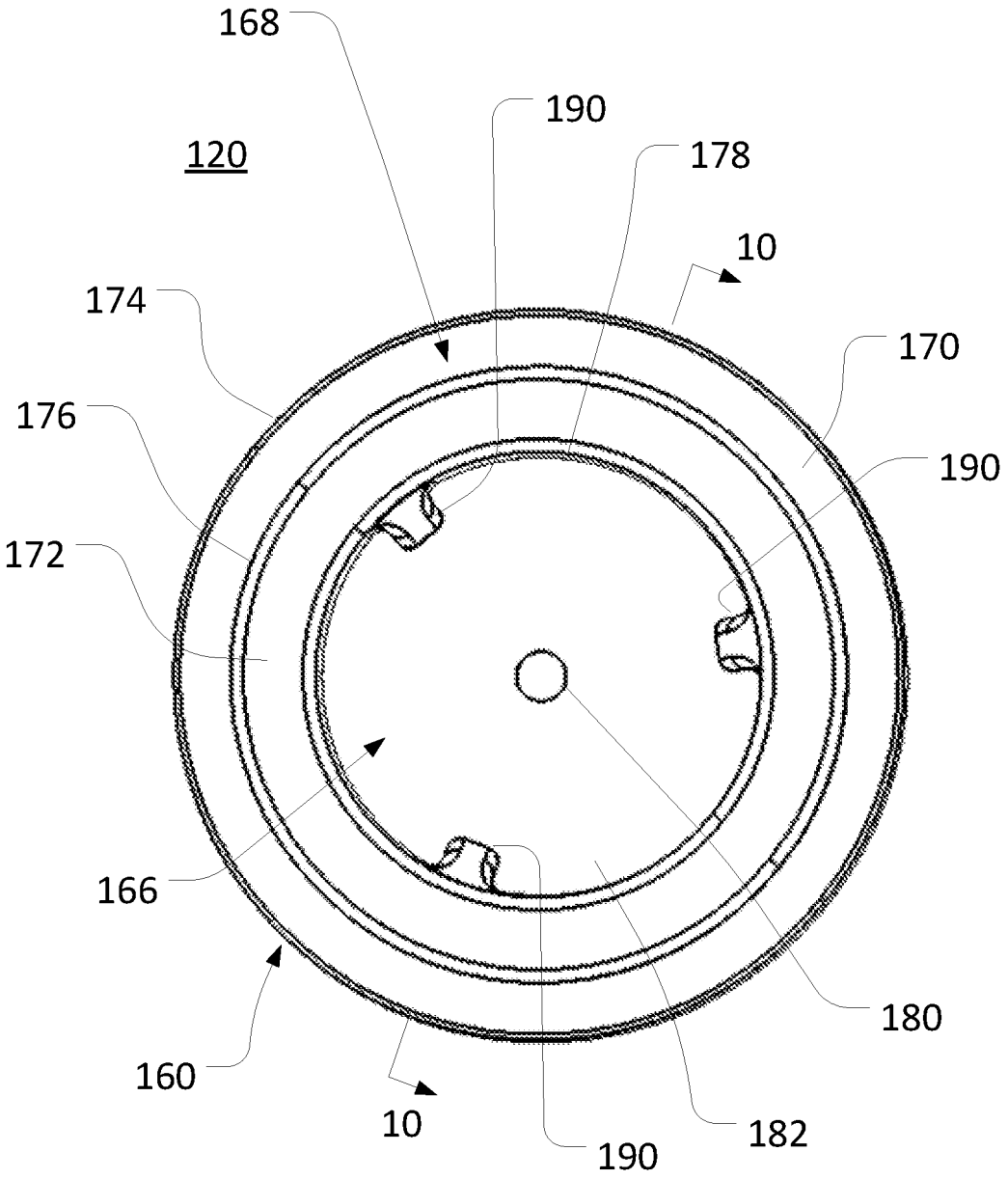
FIG. 9 is a right side view of the nozzle insert of FIG. 2.

As illustrated in FIGS. 9 and 10 in particular, the insert outlet end 162 includes an orifice 180 that extends therethrough to provide fluid communication between the interior cavity 166 of the nozzle insert 120 and the atmosphere. In the illustrated embodiment, the orifice 180 extends through the insert outlet end 162 from a radially extending inner insert wall 182 to a radially extending outer insert wall 184. In some embodiments, for example, a diameter or other aspect of the orifice 180 may be designed to achieve a desired flow pattern and/or atomization of the fluid flowing therethrough. In the illustrated embodiment, the orifice 180 is arranged along the central axis A defined by the nozzle insert 120 (see, e.g., FIG. 10). In some embodiments, for example, the orifice 180 may be eccentrically arranged on the insert outlet end 162 to provide a desired flow pattern and/or atomization of the fluid flow therethrough. In some embodiments, multiple outlet orifices may be provided.

Figure 7:
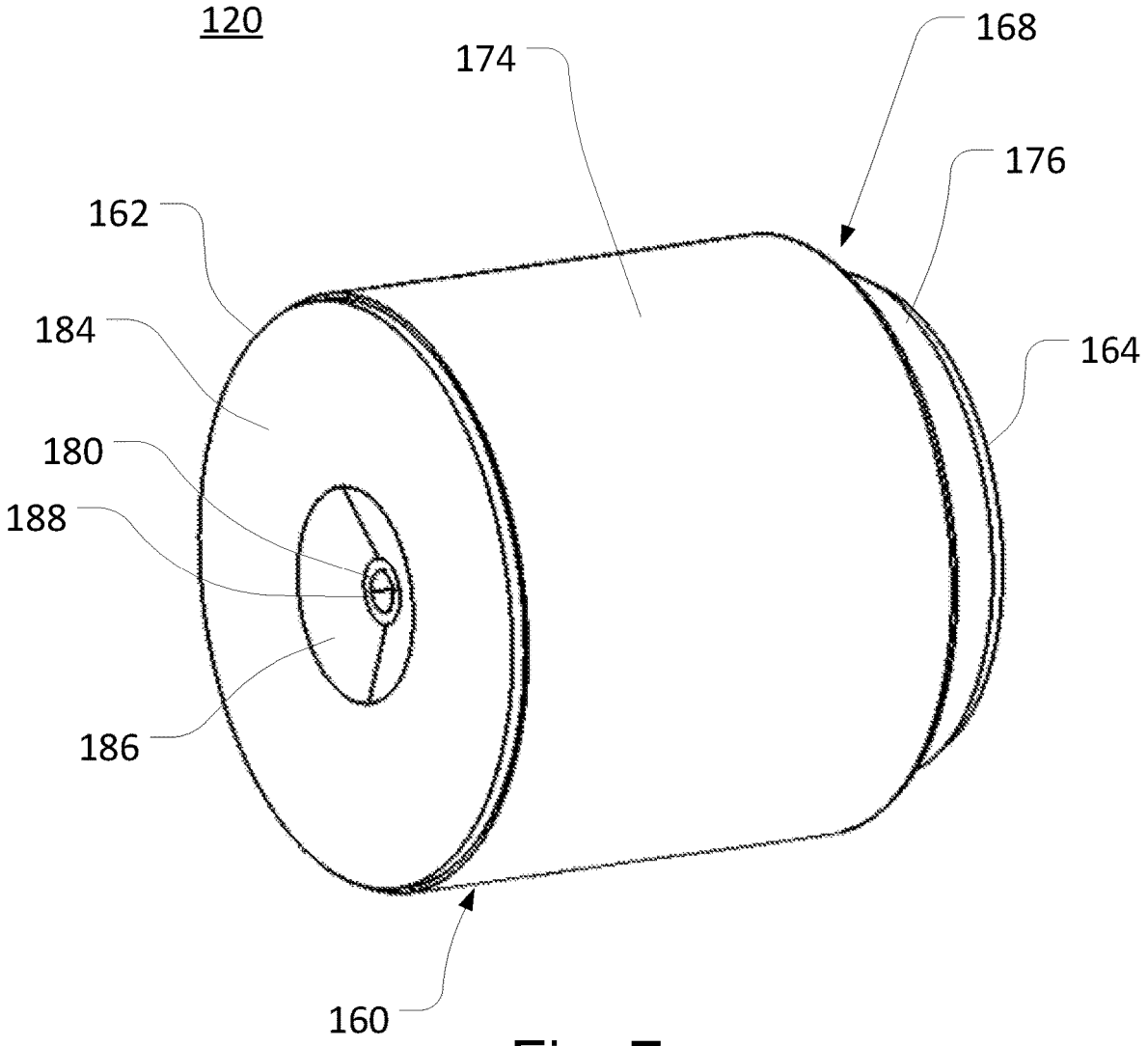
FIG. 7 is a top, front, left, isometric view of the nozzle insert of FIG. 2.

As illustrated in FIGS. 7 and 10 in particular, the outer insert wall 184 includes a recessed portion 186 arranged generally concentrically with the orifice 180. The recessed portion 186 defines a generally frustoconical recesses in the outer insert wall 184 that decreases in diameter (with respect to the central axis A) as the recesses extends axially toward the inner insert wall 182 (see FIG. 10). The recessed portion 186 extends axially from the outer insert wall 184 to an outlet 188 of the orifice 180 at a location between the outer insert wall 184 and the inner insert wall 182. In other embodiments, for example, the outer insert wall 184 may define a generally flat profile without a recessed portion, or a profile with a protruding portion, or may include multiple recessed or protruding portions or a recessed portion with a different profile than illustrated. Similarly, in other embodiments, a nozzle assembly can exhibit other configurations to impart desired flow characteristics to a product stream. For example, in some embodiments, an actuator can include various grooves or channels that lead to an outlet swirl chamber, from which fluid can pass to the orifice 180 to be dispersed.

As illustrated in FIG. 10 in particular, a radially outer wall of the interior cavity 166, as provided by the interior surface 178 of the nozzle body 160, defines an inner diameter $D_I$ that is generally constant along the interior cavity 166, between the inner insert wall 182 and the insert inlet end 164. In the illustrated embodiment, a plurality of ribs 190 extend generally radially inward toward the central axis A from the interior surface 178 of the nozzle body 160, resulting in local deviations from the diameter $D_I$ along the ribs 190. In the embodiment illustrated, the nozzle insert 120 includes three ribs 190 arranged circumferentially around the interior surface 178 in approximately one hundred and twenty degree increments. In other embodiments, for example, the nozzle insert 120 may include more or fewer ribs, or may include flats, any of which may be arranged circumferentially around the interior surface 178 in any increment, as desired.

In the illustrated embodiment, each of the plurality of ribs 190 includes a ramp portion 192 and a spacer portion 194. Each of the plurality of ribs 190 extend axially along the interior surface 178 from between the insert inlet end 164 and the inner insert wall 182. Moving in a direction from the insert inlet end 164 toward the inner insert wall 182 (i.e., opposite to the insertion direction 156 (see FIG. 3)), each of the plurality of ribs 190 begins at the ramp portion 192, which tapers radially inward from the interior surface 178 toward the central axis A as the ramp portion 192 extends axially toward a junction between the ramp portion 192 and the spacer portion 194. At the junction between the ramp portion 192 and the spacer portion 194, the radially inward taper of the ramp portion 192 discontinues and the spacer portion 194 extends in the axial direction to the inner insert wall 182 with a generally constant radial thickness. As also discussed below, the ribs 190 are configured to engage the post 142 of the nozzle-insert cavity 126 (see, e.g., FIG. 3) to center, or otherwise align, and secure the nozzle insert 120 within the nozzle-insert cavity 126.

FIG. 11 illustrates a portion of the product dispensing system 100 with the nozzle insert 120 included in the actuator assembly 104, and with the actuator assembly 104 assembled and installed onto the container 102. In general, to assemble the actuator assembly 104 as illustrated, the central axis A can be generally aligned with the chamber axis C, and the nozzle insert 120 can then be slid into the nozzle-insert cavity 126 of the actuator 118 along the insertion direction 156 (e.g., a direction in parallel with the central axis A and the chamber axis C). As a result, the insert inlet end 164 of the nozzle insert 120, and the interior cavity 166 generally, can slidably receive the post 142 to position the nozzle insert 120 within the nozzle-insert cavity 126.

During assembly, as the post 142 is received within the interior cavity 166 of the nozzle insert 120, the post 142 engages one or more of the plurality of ribs 190 on the interior surface 178 of the nozzle insert 120. Due to the taper of the ramp portions 192, the plurality of ribs 190 are configured to guide the post 142 to a desired alignment within the interior cavity 166 (or, correspondingly, to guide the nozzle insert 120 into appropriate alignment with the post 142 and the nozzle-insert cavity 126). Once the distal end 144 of the post 142 passes over the junction between the ramp portions 192 and the spacer portions 194, the spacer portions 194 act to set the alignment of the post 142 within the interior cavity 166 and correspondingly, to set the alignment of the nozzle insert 120 with the post 142 and the nozzle-insert cavity 126. In the embodiment illustrated, the nozzle insert 120 is aligned generally coaxially with the nozzle-insert cavity 126 after assembly. In some embodiments, the nozzle insert 120 may be otherwise aligned with the nozzle-insert cavity 126 (e.g., disposed eccentrically within the nozzle-insert cavity 126) after assembly.

In some embodiments, a radial height defined between the spacer portions 194 and the interior surface 178 of the nozzle insert 120 determines a radial gap between the post 142 and the interior surface 178 through which fluid flows. Alternatively or additionally, the radial gap between the post 142 and the interior surface 178 may be determined by the geometric difference between the inner diameter $D_I$ of the interior cavity 166 (see, e.g., FIG. 10) and the diameter $D_P$ of the post 142 (see, e.g., FIG. 3). For example, in embodiments without the ribs 190 such as embodiments in which a nozzle insert is secured via engagement between a radial inner wall of a nozzle cavity and a radially outer wall of the nozzle insert, spacing between the post 142 and the interior surface 178 of a nozzle insert may be determined by the difference between $D_I$ and $D_P$.

In other embodiments, other configurations are possible. In some embodiments, for example, one or more ribs may be arranged on the post 142 and extend radially outward therefrom (not shown). In these embodiments, for example, the ribs may be arranged such that ramp portions thereof are arranged adjacent to the distal end 144 of the post 142, to guide insertion of the nozzle insert 120. As another example, in some embodiments, the actuator assembly 104 (see, e.g., FIG. 2) may include another component distinct from the post 142 and the nozzle insert 120 that is configured to align the post 142 within the interior cavity 166 or set the radial flow gap between the post 142 and the interior surface 178. For example, a shim structure that enables fluid flow at least partially therethrough may be configured to be installed onto the post 142 (or the nozzle insert 120) prior to insertion of the nozzle insert 120 into the nozzle-insert cavity 126. In some embodiments, other integral structures on the nozzle insert 120 and/or on the post 142 can provide appropriate spacing between the nozzle insert 120 and the post 142. In some embodiments, no post may be provided, with an internal flow path for product being defined solely by a nozzle insert alone, or by a combination of a nozzle insert and other features within a nozzle-insert cavity.

As a further example, in some embodiments, components of an actuator assembly may not include ribs similar to the ribs 190, a post similar to the post 142, or other similar internal aligning structures. In these embodiments, for example, a nozzle insert may be designed to mainly engage an actuator via a press-fit engagement with an internal circumferential wall of a nozzle-insert cavity. For example, a nozzle body may exhibit a radially outer dimension configured for press-fit engagement with a radially outermost inner surface of the nozzle-insert cavity. This press-fit arrangement between the nozzle insert and the nozzle-insert cavity may inherently align the nozzle insert within the nozzle-insert cavity and set appropriate flow gaps (if any) between the interior surface of the nozzle insert and corresponding structures within the nozzle-insert cavity, such as a flow gap corresponding to the geometric difference between the inner diameter $D_I$ of the interior cavity 166 and the diameter $D_P$ of the post 142).

Referring again to FIG. 11, after (or before) the actuator assembly 104 is properly assembled, the actuator assembly 104 is installed onto the container 102 (see, e.g., FIG. 2) such that a portion of the valve stem 116 is received within the stem socket 128 of the actuator 118. Product can then be dispensed from the container 102, for example, via manual or automatic displacement of the actuator assembly 104, which, in turn, displaces the valve stem 116 in such a way that the product is released therefrom. From the valve stem 116, the product flows through the inlet passageway 124 and into the nozzle-cavity inlet 130. The product then flows downstream into the distribution chamber 150, then around the post 142 and into the radial flow gap between the post 142 and the interior surface 178 of the nozzle insert 120. Once the product flows through the nozzle insert 120, it is expelled to the atmosphere through the orifice 180. In some embodiments, the outer diameter $D_S$ of the distribution chamber 150 (see FIG. 3) may be approximately equal to the inner diameter $D_I$ defined by the interior cavity 166 of the nozzle insert 120 (see FIG. 10), such that a relatively continuous and constant-radius flow boundary is provided along the distribution chamber 150 and the nozzle insert 120.

In order to optimally dispense product through the nozzle insert 120 and the assembly 104 in general, the nozzle insert 120 can be inserted into the nozzle insert cavity 126 by a first distance along the insertion direction 156 to an operational position (i.e., can be inserted by an operational insertion distance). Such an arrangement is illustrated in FIG. 11. In some cases, however, further insertion of the nozzle insert 120 may eventually occur, including due to manufacturing error or user interactions. For example, during the assembly of the actuator assembly 104, an axial compression force is applied to the nozzle insert 120 to insert the nozzle insert 120 into the nozzle-insert cavity 126. In conventional assemblies, if a nozzle insert is over-compressed during (or after) insertion, features on the nozzle insert and the relevant supporting structure (e.g., the post 142 or other features within the nozzle-insert cavity 126) may be plastically deformed (e.g., coined) at and around contact points therebetween. This deformation could, for example, result in the desired flow pattern of the relevant product being impeded or otherwise degraded. In some cases, this could even result in complete blockage of product flow, so that the system would be non-functional.

As also noted above, embodiments of the present disclosure can be useful to help to prevent and otherwise mitigate (e.g., reduce) these and other effects of over-compression of a nozzle insert. Accordingly, some embodiments of the present disclosure, including embodiments of the product dispensing system 100 described herein, can include structural features that are configured to hinder (e.g., prevent), the nozzle insert 120 from being over-inserted into the nozzle-insert cavity 126, and/or to mitigate the effects of corresponding over-compression. For example, as also discussed above, the nozzle-insert cavity 126 includes the stop portion 134, including the first stop surface 146 and the second stop surface 148, which are configured to successively engage the stop portion 168 of the nozzle insert 120 (e.g., at the insert stop surfaces 170 and 172, respectively) at predetermined axial depths into the nozzle-insert cavity 126 in order to protect against the effects of over-compression.

In different embodiments, relevant stop portions (e.g., stop surfaces thereof) can be configured in different ways. Generally, an axial sequence of multiple stops of a stop portion of one component (e.g., an insert) can be configured to successively engage one or more corresponding stops of a stop portion of another component (e.g., within an insert cavity), in order to provide successive instances of resistance to further insertion. In some embodiments, to this end, pairs of stops on different components can be formed with complimentary geometries. In the embodiment illustrated, for example, the nozzle insert 120 defines a stop portion 168 with a generally stepped profile adjacent to the open end 164, which is configured to successively engage the generally stepped profile of the stop portion 134 within the nozzle-insert cavity 126 (or another stop portion on another component of a product dispensing system) as the nozzle body 160 is inserted into the component along the insertion direction 156 (see FIGS. 3 and 11).

In particular, in the illustrated embodiment, the first stop surface 146 and the second stop surface 148 of the actuator 118 are configured as tiered steps, with generally planar radially-extending surfaces, as are the first insert stop surface 170 and the second insert stop surface 172 of the nozzle insert 120. Further, with the nozzle insert 120 positioned for insertion into the nozzle-insert cavity 126, the first stop surface 146 and the second stop surface 148 are generally aligned with the first insert stop surface 170 and the second insert stop surface 172 of the nozzle insert 120, respectively, to allow corresponding reaction forces to be generated in response to over-compression (and over-insertion) of the nozzle insert 120. Thus, upon over-compression (and corresponding over-insertion) of the nozzle insert 120, successive engagement between the first cavity stop surface 146 and the first insert stop surface 170 and between the second cavity stop surface 148 and the second insert stop surface 172 successively generate reaction forces in an axial direction opposite to the axial compression force applied to the nozzle insert 120 (i.e., generally opposite the insertion direction 156 (see FIGS. 3 and 11) for the nozzle insert 120).

Providing further example benefits, in the illustrated embodiment, the axial distance between the first cavity stop surface 146 and the second cavity stop surface 148 is generally greater than the axial distance between the first insert stop surface 170 and the second insert stop surface 172. Accordingly, for example, as the nozzle insert 120 is inserted into the nozzle-insert cavity 126 in the insertion direction 156 (e.g., axially inserted), the first cavity stop surface 146 is brought into engagement with the first insert stop surface 170 before the second cavity stop surface 148 engages the second insert stop surface 172. This may be useful, for example, to provide a first tactile indicator of appropriate compression (or relatively small over-compression), or to initially distribute over-compression forces in a useful (or relatively non-damaging) way. The second stop surface 148, for example, can then provide another (e.g., stronger) tactile indicator of over-insertion (and over-compression), as well as a stronger resistance to further over-insertion of the nozzle insert 120.

In some embodiments, flow through the actuator assembly 104 can be substantially shut off upon the first cavity stop-surface 146 engaging the first insert stop surface 170. In some embodiments, determining whether flow is actually shut off upon engagement of the first cavity stop-surface 146 with the first insert stop surface 170 can assist in refining manufacturing procedures for the actuator assembly 104. For example, in the illustrated embodiment, a finding that flow through the actuator assembly 104 does not shut off until the second cavity stop surface 148 engages the second insert stop surface 172 may indicate that assembly pressure for the actuator assembly 104 should be reduced.

Figure 12:
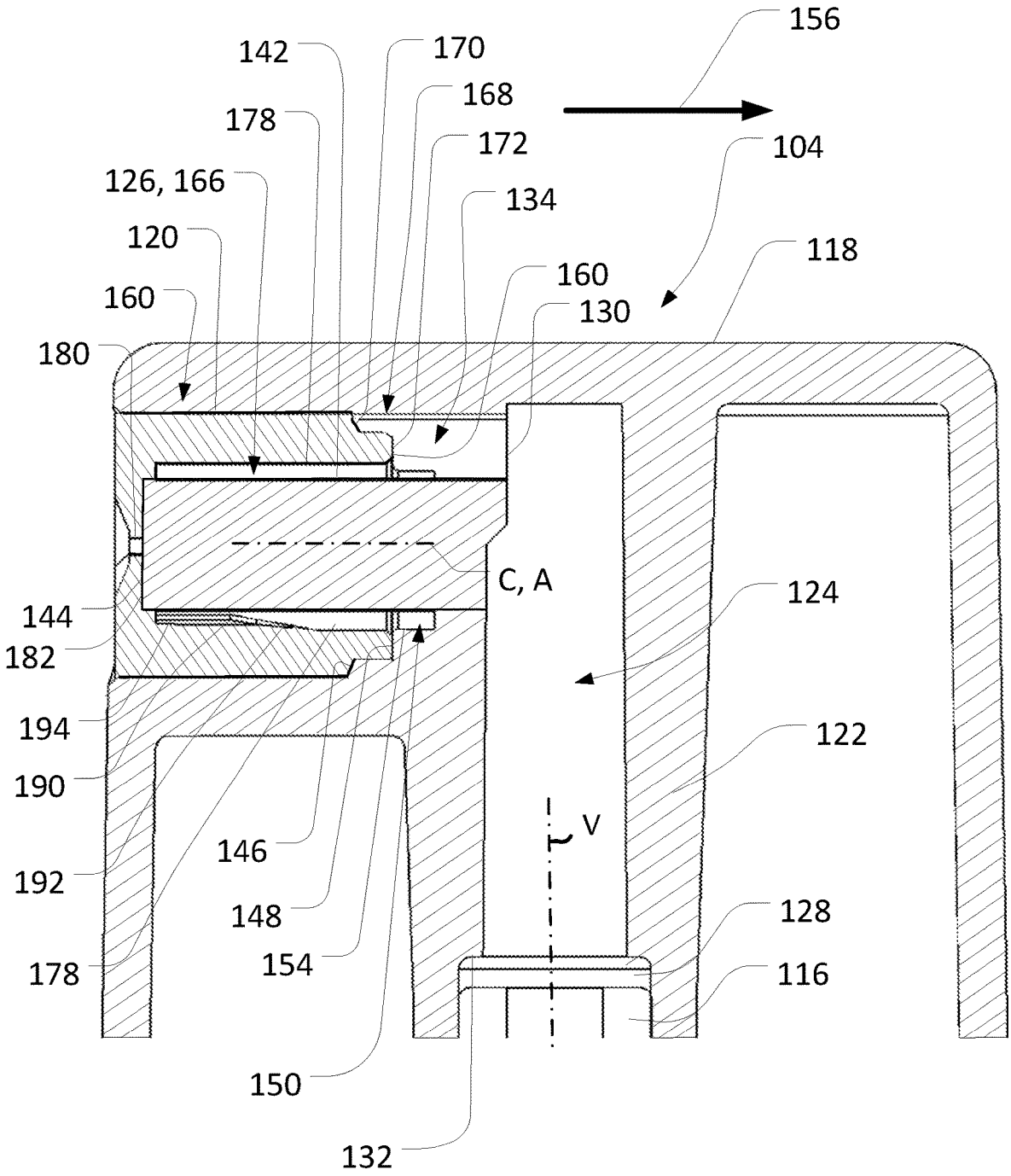
FIG. 12 is a partial cross-sectional view of the actuator, the nozzle insert, and the valve stem of FIG. 2 taken along line 12-12 of FIG. 2, with the nozzle insert inserted into the actuator past the operational position.

In some embodiments, one or more stop portions can be designed to deform as a result of over-insertion of a nozzle insert. In the illustrated embodiment, one or both of the first stop surfaces 146 and 170 can be configured to deform when the nozzle insert 120 is inserted into the nozzle-insert cavity 126 past a position in which stop portions of the nozzle insert and nozzle cavity first engage. For example, as illustrated in FIG. 12, when the nozzle insert 120 has been inserted past its operational position (see FIG. 11) and past initial engagement of the first stop surfaces 146 and 170, one or both of the stop surfaces 146 and 170 can deform (e.g., can coin together) to permit engagement between the second stop surface 148 and the second insert stop surface 172. The engagement between the second stop surface 148 and the second insert stop surface 172 then acts to mitigate effects of further over-compression of the nozzle insert 120 by, for example, providing another reaction force that originates from the second stop surface 148 and acts on the nozzle insert 120 in an axial direction opposite to the axial over-compression force.

In some embodiments, the deformation of the first stop surface 146, the first insert stop surface 170, and/or another component of the actuator assembly 104 results in an alternative orientation of the relevant component compared to its free, undeformed state. For example, as illustrated in FIG. 12, the deformation of the first stop surfaces 146 and 170 can result in the first stop surfaces 146 and 170 plastically deforming, such that the first stop surfaces 146 and 170 are no longer parallel to the second stop surface 148, and are angled in a direction axially toward the second stop surface 148. In some embodiments, for example, this deformation of the first stop surfaces 146 and 170 (or one of the surfaces 146 and 170) can allow the first stop surfaces 146 and 170 to still resist over-insertion of the nozzle insert 120, while also allowing the subsequent engagement between the second cavity stop surface 148 and the second insert stop surface 172.

In some embodiments, a stop portion (e.g., the stop portion 134) can mitigate the effects of over-compression in different ways. In some embodiments, for example, the reaction forces generated by engagement of the nozzle insert 120 with the one or more of the first stop surface 146 and the second stop surface 148 can directly protect the features of the actuator 118 and the nozzle insert 120 from excessive plastic deformation due to over-compression. For example, engagement of both sets of stop surfaces 146, 148 and surfaces 170, 172 can spread over-compressive loads over a larger contact area, thereby reducing and/or relocating the resulting strain on the nozzle insert 120. As another example, in some embodiments, the reaction forces can help to prevent excessive insertion of the nozzle insert by physically blocking axial movement thereof. This can be useful, for example, to protect the insert outlet end 162 from being excessively deformed (e.g., coined) by compression against the post 142, which can help to protect the integrity of the relevant flow path(s) out of the nozzle assembly.

In some embodiments, other benefits can accrue from orienting the stop portion 168 at, or relatively close to, the inlet end 164 of the nozzle insert 120. In some embodiments, for example, this configuration can help to enable a floating configuration for the actuator assembly 104 generally. For example, with the stop portion 168 oriented close to the inlet end 164 of the nozzle insert 120, the nozzle insert 120 can be inserted to be flush or inset relative to an outer surface of the actuator 118. Correspondingly, the actuator 118 can be configured to have no required rotational orientation relative to the cover 106 (see FIG. 1), and interference between the nozzle insert 120 and the cover 106 can be avoided during placement of the cover 106 over the actuator 118.

In some embodiments, engagement between the first cavity stop surface 146 and the first insert stop surface 170 (or other initial engagement between corresponding stops) results from appropriate, operational insertion of the nozzle insert 120 into the nozzle-insert cavity 126 (e.g., rather than from over-compression of the nozzle insert 120). For example, in some embodiments, the first insert stop surface 170 engages the first cavity stop surface 146, without the second insert stop surface 172 engaging the second cavity stop surface 148, when the nozzle insert 120 has been inserted into the nozzle-insert cavity 126 merely to the operational position of the nozzle insert 120. This stands in contrast, for example, to the arrangement illustrated in FIG. 11, in which the nozzle insert 120 is in the operational position but the stop surfaces 146 and 170 have not yet engaged each other.

Figure 13:
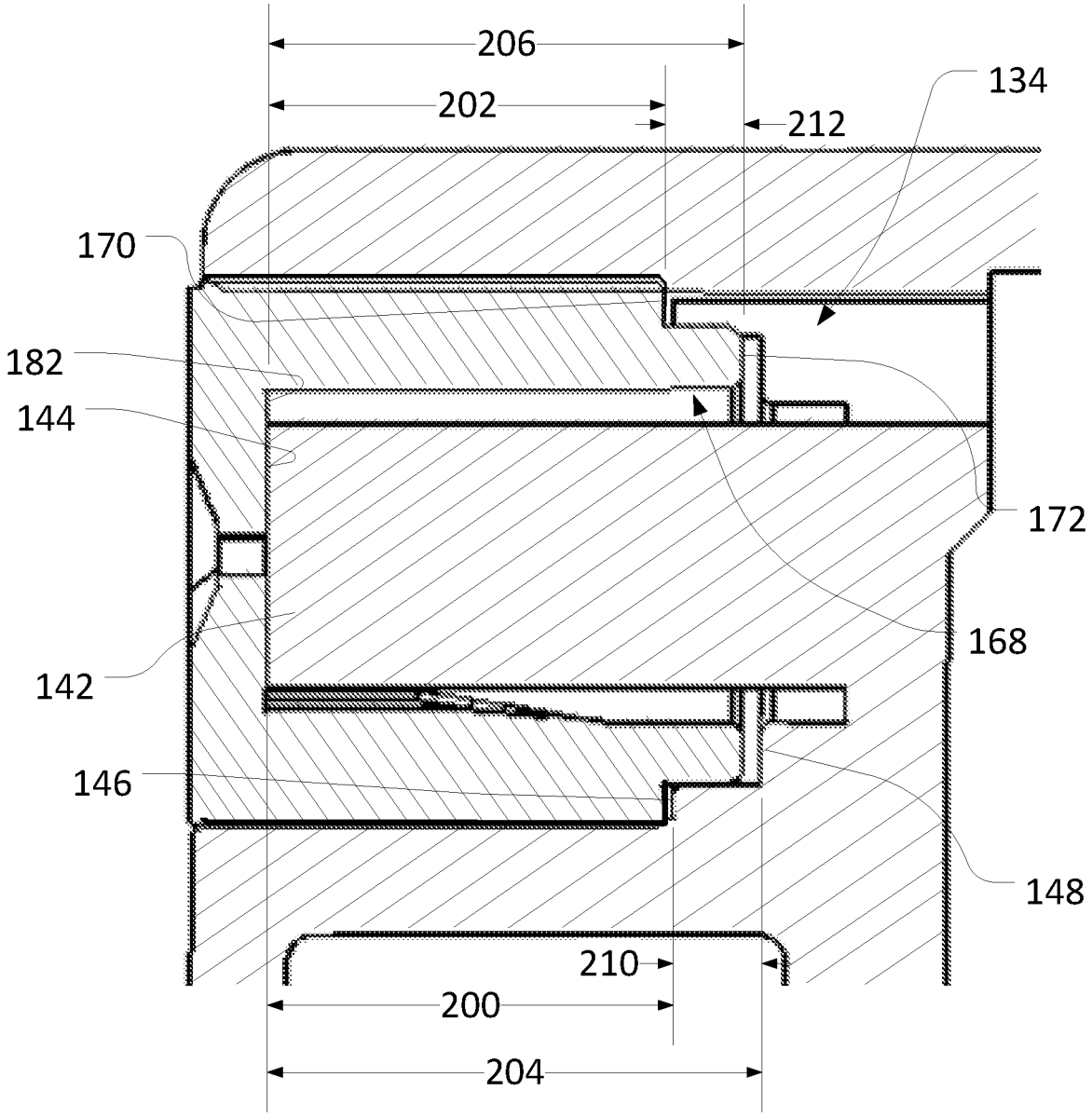
FIG. 13 is an enlarged, partial cross-sectional view of the actuator, the nozzle insert, and the valve stem of FIG. 2, taken from a similar perspective as FIG. 11.

In this regard, for example, it may be useful to configure the post 142, the nozzle-insert cavity 126, and the nozzle insert 120 (or other relevant structures) with particular dimensional relationships, so that initial and subsequent engagement between stop portions can be distinguished (i.e., be made non-simultaneously) and so that initial engagement between stop portions does not occur until or after the nozzle insert 120 reaches an operational position. For example, as illustrated in FIG. 13, an axial spacing 200 between the distal end 144 of the post 142 and the first cavity stop surface 146 can be selected to be equal to or greater than an axial spacing 202 between the inner insert wall 182 and the first insert stop surface 170. Similarly, an axial spacing 204 between the distal end 144 of the post 142 and the second cavity stop surface 148 can be selected to be equal to or greater than an axial spacing 206 between the inner insert wall 182 (see, e.g., FIG. 9) and the second insert stop surface 172. Further, to ensure that the first stop surfaces 146 and 170 engage before the second stop surfaces 148 and 172, the difference between the axial spacings 200 and 202 can be selected to be generally smaller than the difference between the axial spacings 204 and 206. Or, correspondingly, an axial spacing 210 between the first and second cavity stop surfaces 146 and 148 can be selected to be generally larger than an axial spacing 212 between the first and second insert stop surfaces 170 and 172.

In some embodiments, dimensional relationships such as those described above can be selected to account for appropriate manufacturing tolerances. For example, the axial spacings 200 and 202 can be selected so that the first insert stop surface 170 engages the first stop surface 146, without over-compression of the nozzle insert 120, only when the axial spacings 200 and 202 are at the worst possible deviations from nominal, under the relevant manufacturing tolerances (e.g., with the spacing 202 at a maximum and the spacing 200 at a minimum). Similarly, the axial spacings 210 and 212 can be selected so that engagement between the second insert stop surface 172 and the second cavity stop surface 148 does not occur upon an initial (e.g., non-deformed) engagement between the first cavity stop surface 146 and the first insert stop surface 170, even with the spacings 210 and 212 at the worst possible deviations from nominal, under the relevant manufacturing tolerances (e.g., with the spacing 212 at a maximum, and the spacing 210 at a minimum). Further, in some cases, appropriate manufacturing tolerances can be selected based on similar considerations.

In other embodiments, other configurations are possible. For example, whereas the distal end 144 of the post 142 provides an operational support surface for the nozzle insert 120 in the illustrated embodiment, other systems can include other components (e.g., other structures on an actuator) that can provide other operational support surfaces, to similarly engage and support a nozzle insert in the operational position. In some embodiments, these components (or structures) can be configured with relative spacings, as compared to the corresponding nozzle inserts, that are generally similar to those described above for the post 142, the nozzle-insert cavity 126, and the nozzle insert 120. For example, actuators in some embodiments may include nozzle-insert cavities with operational support surfaces on internal ribs, rings, or other structures (not shown) that can engage corresponding structures on a nozzle insert (e.g., external rings, ribs, or other structures (not shown)) in order to support the nozzle insert at an operational depth. In some embodiments, appropriate spacings between such structures and a relevant stop portion of the actuator can exhibit relationships to corresponding spacings on a nozzle insert that are similar to those described above for the post 142, the nozzle-insert cavity 126, and the nozzle insert 120.

Other benefits can also be obtained, in some embodiments, including with regard to flow patterns for product moving through a nozzle insert. For example, as illustrated in FIG. 11 in particular, at least part of the interior surface 178 of the nozzle body 160 can be generally aligned with the connecting surface 154 (e.g., with $D_I$ generally equal to $D_S$ (see FIGS. 3 and 10)) when the nozzle insert 126 has been inserted. As also discussed above, this can provide a generally consistent boundary for flow along the inside of the nozzle insert 126, as product moves from the nozzle-cavity inlet 130 to the orifice 180. As illustrated in FIG. 12, this alignment and the correspondingly consistent flow boundary can sometimes be maintained even when the stop portions of the nozzle insert 120 and the nozzle-insert cavity 126 have been deformed (e.g., due to over-compression).

As another example, as also discussed above, the general configuration of the stop portion 134 can provide the distribution chamber 150, which is in fluid communication with the nozzle-cavity inlet 130 and partly surrounds the post 142 near the nozzle-cavity inlet 130. This can, for example, help to provide appropriately uniform circumferential distribution of product around the post 142 and the nozzle insert 126 in general, or to otherwise assist in appropriate distribution or mixing of a product.

In the example configurations illustrated in FIGS. 11-13, clearance between the distal end 144 of the post 142 and the inner wall 182 of the nozzle insert 120, as needed to permit fluid to flow from the nozzle-insert cavity 126 out of the orifice 180, is provided but is not expressly shown. Embodiments of the disclosure can help to define and preserve such clearance, including in deformed configurations (see, e.g., FIG. 12), so that products can be dispersed appropriately.

Figure 14:
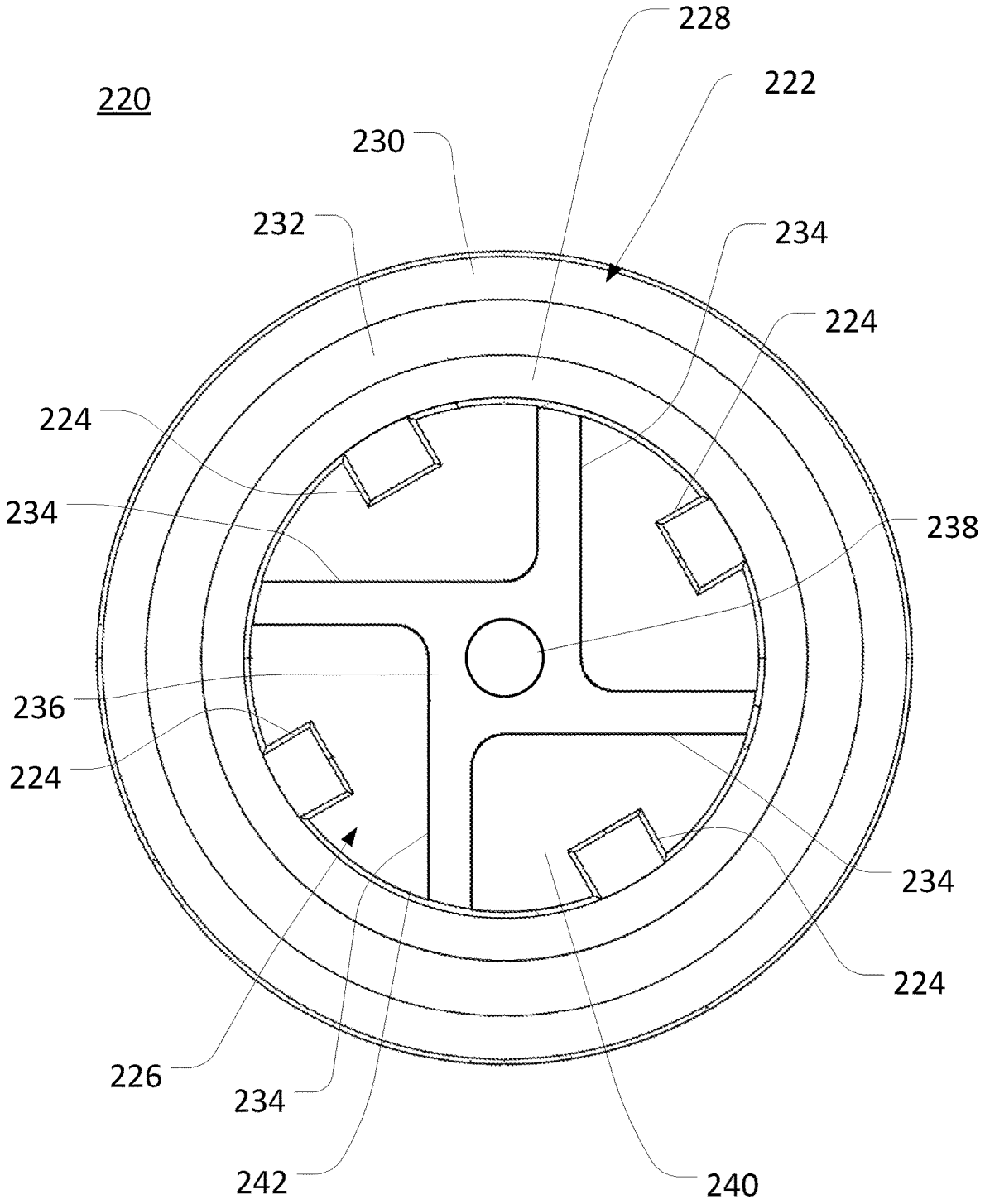
FIG. 14 is a rear elevation view of a nozzle insert according to another embodiment.

In some embodiments, clearance for outflow of product can be provided by flow channels and an outlet swirl chamber that are formed by contours on an inner wall of a nozzle insert such as the inner wall 182 (see, e.g., FIG. 11), on a distal end of a post such as the distal end 144 of the post 142 (see, e.g., FIG. 11), or on other similar features within a nozzle cavity. For example, FIG. 14 illustrates a nozzle insert 220 configured for use with the actuator 118 (see, e.g., FIG. 11), with integrally formed flow channels for product dispersal, as further discussed below.

Similarly to the nozzle insert 120, the nozzle insert 220 includes a stepped stop portion 222 and a set of ribs 224 extending radially into a generally cylindrical interior cavity 226. Accordingly, the nozzle insert 220 can be received and secured within the actuator 118 similarly to the nozzle insert 120, as illustrated for the nozzle insert 120 in FIGS. 11-13.

In some aspects, the nozzle insert 220 varies from the nozzle insert 120. For example, the nozzle insert 220 includes a chamfered inner wall 228 to the interior of first and second stops 230, 232 of the stop portion 222. As another example, the nozzle insert 220 includes a set of interconnected channels 234 leading to a swirl chamber 236 that is aligned with a central outlet orifice 238. Collectively, the channels 234 and the swirl chamber 236 provide a set of flow paths that extend along an inner wall 240 of the nozzle insert 220, from an interior surface 242 of the interior cavity 226 to the orifice 238. Accordingly, with the inner wall 240 of the nozzle insert 220 seated against or disposed adjacent to the distal end of a post of a nozzle-insert cavity, similarly to the nozzle insert 120 in the configuration of FIG. 11, product can flow from the nozzle-insert cavity, through the channels 234 and the swirl chamber 236, to be dispensed through the orifice 238. Further, due to the illustrated configuration of the channels 234 and of the swirl chamber 236, product can continue to be dispensed through the orifice 238 in certain over-compressed configurations, such as when the nozzle insert 220 is over-compressed against a distal end of a post similarly to the nozzle insert 120 in the configuration of FIG. 12.

In other embodiments, other configurations are possible. For example, channels for flow of product to one or more outlet orifices of a nozzle insert can be formed on a distal end of a post similar to the post 142, or on other similar features, instead of or in addition to being formed on an inner wall of the nozzle insert, such as the inner wall 240. In some embodiments, certain flow paths for product can be defined by raised or otherwise protruding features, rather than recessed channels. In some embodiments, an outlet swirl chamber can have a different geometric shape than the swirl chamber 236, such as a circular or other shape, and flow channels leading to an outlet swirl chamber, such as the channels 234, can define curved or other flow paths. In some embodiments, an outlet swirl chamber can have stepped or curved walls leading to one or more outlet orifices. Similarly, in some embodiments, flow channels such as the channels 234 can be formed with stepped or curved walls leading to an outlet swirl chamber.

Thus, embodiments of the present disclosure provide an actuator assembly or nozzle insert for a product dispensing system. In some embodiments, the improved actuator assembly or nozzle insert can provide improved manufacturability and reduce defects arising during assembly (or use) from over-compression of a nozzle insert. For example, some embodiments of the invention provide a nozzle insert, and a corresponding nozzle-insert cavity in an actuator of an actuator assembly, with first and second stop portions that can mitigate the effects of over-compression of the nozzle insert. This can, for example, correspondingly reduce (e.g., eliminate) the probability of forming defects in the actuator assembly during assembly.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

The invention claimed is:

1. A nozzle insert configured to be inserted along an insertion direction into a component of a product dispensing system, wherein the component includes a component stop portion with a sequence of stops separated along the insertion direction, the nozzle insert comprising:

an outlet end having a first outer surface defining a first outer periphery, wherein two points located on opposing sides of the first outer periphery are separated by a first distance;

an inlet end having a second outer surface defining a second outer periphery, wherein two points located on opposing sides of the second outer periphery are separated by a second distance that is less than the first distance; and a stepped profile including a first insert stop surface, wherein the stepped profile is configured to successively engage the sequence of stops as the nozzle insert is inserted into the component along the insertion direction, and wherein the first insert stop surface extends radially inwardly between the first outer surface and the second outer surface, such that a first axial distance measured between the first insert stop surface and the outlet end is greater than a second axial distance measured between the first insert stop surface and the inlet end.

2. The nozzle insert of claim 1, wherein the nozzle insert is configured to be inserted into the component along the insertion direction, to an operational insertion distance, to receive product at the inlet end and dispense product through the outlet end, and wherein, an initial engagement, between the sequence of stops and the first insert stop surface of the stepped profile, occurs when the nozzle insert is inserted into the component by a first insertion distance equal to or greater than the operational insertion distance.

3. The nozzle insert of claim 2, wherein the first insertion distance is greater than the operational insertion distance.

4. The nozzle insert of claim 2, wherein a subsequent engagement between the sequence of stops and a second insert stop surface of the stepped profile occurs when the nozzle insert is inserted into the component by a second insertion distance greater than the first insertion distance.

5. The nozzle insert of claim 4, wherein one or more of the stepped profile and the sequence of stops is configured to deform, when the nozzle insert is inserted into the component by the second insertion distance, to permit the subsequent engagement.

6. The nozzle insert of claim 4, wherein, the initial engagement includes the first insert stop surface engaging a first component stop surface of the sequence of stops and the subsequent engagement includes the second insert stop surface engaging a second component stop surface of the sequence of stops; and wherein, when the nozzle insert is inserted into the component by the first insertion distance, the first insert stop surface engages the first component stop surface without the second insert stop surface engaging the second component stop surface.

7. The nozzle insert of claim 6, wherein the first insert stop surface extends over a smaller radial distance than the second insert stop surface.

8. The nozzle insert of claim 6, wherein the first insert stop surface is at least partly disposed radially outwardly relative to the second insert stop surface.

9. The nozzle insert of claim 1, with the component stop portion being disposed within a nozzle-insert cavity of the component and including a connecting surface that at least partly defines a distribution chamber, wherein the nozzle insert includes an internal cavity at least partly defined by an interior surface of the nozzle insert, with the interior surface of the nozzle insert being substantially aligned with the connecting surface of the component stop portion.

10. The nozzle insert of claim 1, with the component including a nozzle-insert cavity with an interior post having an operational support surface, wherein the nozzle insert engages the operational support surface when the nozzle insert is inserted into the nozzle-insert cavity, along the insertion direction, to an operational insertion distance.

11. An actuator assembly for a product dispensing system, the actuator assembly comprising:

a nozzle insert that includes an insert stop portion with a first insert stop surface and a second insert stop surface that are separated along an insertion direction; and an actuator including a nozzle-insert cavity, wherein the nozzle-insert cavity includes a cavity stop portion having a first cavity stop surface and a second cavity stop surface that are separated along the insertion direction, wherein the nozzle insert is configured to be inserted into the nozzle-insert cavity by a first distance along the insertion direction, for operation of the actuator to dispense product through the nozzle insert, wherein, with the nozzle insert inserted into the nozzle-insert cavity by a second distance that is equal to or greater than the first distance, the first insert stop surface engages the first cavity stop surface to impede further insertion along the insertion direction, without the second insert stop surface engaging the second cavity stop surface, and wherein, with the nozzle insert inserted into the nozzle-insert cavity by a third distance that is larger than the second distance, the second insert stop surface engages the second cavity stop surface to further impede further insertion along the insertion direction.

12. The actuator assembly of claim 11, wherein each of the first cavity stop surface, the second cavity stop surface, the first insert stop surface, and the second insert stop surface includes a radially-extending surface.

13. The actuator assembly of claim 12, wherein the first cavity stop surface extends over a smaller radial distance than the second cavity stop surface, and the first insert stop surface extends over a smaller radial distance than the second insert stop surface.

14. The actuator assembly of claim 11, wherein the second cavity stop surface is arranged radially inward relative to the first cavity stop surface, and the second insert stop surface is arranged radially inward relative to the first insert stop surface.

15. The actuator assembly of claim 11, wherein upon insertion of the nozzle insert into the nozzle-insert cavity, the second insert stop surface is disposed farther into the nozzle-insert cavity than is the first insert stop surface.

16. The actuator assembly of claim 11, wherein, with the nozzle insert inserted into the nozzle-insert cavity by the third distance, the first insert stop surface remains engaged with the first cavity stop surface.

17. The actuator assembly of claim 16, wherein insertion of the nozzle insert to the third distance deforms at least one of the first cavity stop surface and the first insert stop surface.

18. A product dispensing system comprising:

a container with a valve assembly;

an actuator including a nozzle-insert cavity having a cavity stop portion, wherein the actuator is configured to interact with the valve assembly to dispense product from the container; and a nozzle insert including an insert stop portion, wherein the nozzle insert is configured to be inserted into the nozzle-insert cavity in an insertion direction, to an operational position, to dispense product through the nozzle insert, wherein at least one of the cavity stop portion and the insert stop portion includes a first stop surface, and a second stop surface that is separated from the first stop surface in the insertion direction, wherein, as the nozzle insert is moved in the insertion direction at least one of to the operational position and past the operational position, the insert stop portion initially engages the cavity stop portion at the first stop surface, but not at the second stop surface, to impede further movement along the insertion direction, and wherein, as the nozzle insert is further moved in the insertion direction, after the insert stop portion initially engages the cavity stop portion at the first stop surface, the insert stop portion engages the cavity stop portion at the first stop surface and at the second stop surface to further impede further movement along the insertion direction.

19. The product dispensing system of claim 18, wherein the second stop surface is disposed at least partly radially inwardly relative to the first stop surface.

20. The product dispensing system of claim 18, wherein the first stop surface is configured to deform, as the nozzle insert is further moved in the insertion direction, after the insert stop portion initially engages the cavity stop portion at the first stop surface, to permit engagement of the insert stop portion and the cavity stop portion at the second stop surface.

* * * * *